US011549784B2

(12) United States Patent
Brown

(10) Patent No.: US 11,549,784 B2
(45) Date of Patent: Jan. 10, 2023

(54) BOW SIGHT ADAPTED TO CONNECT TO CENTER LINE PLANE OF RISER

(71) Applicant: Brown Innovations, LLC, London, KY (US)

(72) Inventor: Kevin E. Brown, London, KY (US)

(73) Assignee: BROWN INNOVATIONS, LLC, London, KY (US)

( * ) Notice: Subject to any disclaimer, the term of this patent is extended or adjusted under 35 U.S.C. 154(b) by 107 days.

(21) Appl. No.: 16/921,025

(22) Filed: Jul. 6, 2020

(65) Prior Publication Data

US 2021/0010780 A1 Jan. 14, 2021

Related U.S. Application Data

(60) Provisional application No. 62/871,839, filed on Jul. 9, 2019.

(51) Int. Cl.
*F41G 1/467* (2006.01)
*F41G 3/08* (2006.01)

(52) U.S. Cl.
CPC ..... *F41G 1/467* (2013.01); *F41G 3/08* (2013.01)

(58) Field of Classification Search
CPC ..... F41B 5/14; F41G 1/467
USPC ..... 124/87; 33/265
See application file for complete search history.

(56) References Cited

U.S. PATENT DOCUMENTS 1,847,593 A * 3/1932 Colin ..... F41G 1/467 124/24.1
1,961,517 A * 6/1934 Klopsteg ..... F41G 1/467 124/24.1
2,163,503 A * 6/1939 Tate ..... F41G 1/467 124/87
2,559,927 A * 7/1951 Beloungy ..... F41G 1/467 33/265
2,600,250 A * 6/1952 Lake ..... F41B 5/0026 124/24.1
2,642,661 A * 6/1953 Fredrickson ..... F41G 1/467 124/24.1
2,665,679 A * 1/1954 Gaskell ..... F41B 5/143 273/DIG. 7
2,900,973 A * 8/1959 Diehr ..... F41B 5/0026 124/24.1
2,909,167 A * 10/1959 Fredrickson ..... F41B 5/143 124/25.7
3,027,648 A * 4/1962 Crook ..... F41G 1/467 33/265
3,058,221 A * 10/1962 McNeel ..... F41G 1/467 33/265
3,302,292 A * 2/1967 Akin, Jr. ..... F41G 1/467 33/265
3,320,670 A * 5/1967 Ambraziatis ..... F41G 1/467 356/252
3,406,675 A * 10/1968 Fredrickson ..... F41B 5/14 124/25.7

(Continued)

*Primary Examiner* — Alexander R Niconovich
(74) *Attorney, Agent, or Firm* — Dickinson Wright PLLC; Nicholas P. Coleman

(57) ABSTRACT

An archery accessory, such as an archery sight, may attach to a riser of a bow along a centerline plane of the riser. This positioning may prevent or reduce any change in balance of the bow. The archery sight may include a sight element that may be adjusted in a horizontal direction by a horizontal adjustment system and in a vertical direction by one or more vertical adjustment systems.

16 Claims, 21 Drawing Sheets

(56) References Cited

U.S. PATENT DOCUMENTS 3,410,644 A * 11/1968 McLendon ..... F41B 5/1419 359/425
3,475,820 A * 11/1969 Kernan ..... F41G 1/467 33/265
3,488,853 A * 1/1970 Altier ..... F41G 1/467 124/87
3,521,362 A * 7/1970 Duplechin ..... F41G 1/467 124/23.1
3,561,418 A * 2/1971 Fredrickson ..... F41B 5/14 124/25.5
3,641,675 A * 2/1972 Funk, Jr. ..... F41G 1/467 356/247
3,693,262 A * 9/1972 Wood ..... F41G 1/467 33/265
3,715,807 A * 2/1973 Heffer ..... F41G 1/467 33/265
4,136,462 A * 1/1979 Topel ..... F41G 1/467 33/265
4,178,693 A * 12/1979 Smith ..... F41G 1/467 33/265
4,507,874 A * 4/1985 Brown ..... F41G 1/467 124/87
4,535,747 A * 8/1985 Kudlacek ..... F41G 1/467 124/87
4,587,945 A * 5/1986 Little ..... F41G 1/467 124/87
4,662,346 A * 5/1987 Laffin ..... F41B 5/143 124/44.5
4,759,337 A * 7/1988 Suski ..... F41B 5/143 124/44.5
4,823,474 A * 4/1989 Reynolds ..... F41G 1/473 124/87
4,858,589 A * 8/1989 Chang ..... F41B 5/143 124/44.5
4,917,072 A * 4/1990 Chang ..... F41B 5/143 124/24.1
5,005,554 A * 4/1991 Shepley ..... F41B 5/143 124/44.5
5,025,565 A * 6/1991 Stenerson ..... F41G 1/467 42/130
5,072,716 A * 12/1991 Sappington ..... F41G 1/467 124/87
5,092,308 A * 3/1992 Sheffield ..... F41B 5/0031 124/91
5,174,269 A * 12/1992 Sappington ..... F41G 1/467 124/87
5,205,268 A * 4/1993 Savage ..... F41B 5/14 124/44.5
5,220,907 A * 6/1993 Lonsdale ..... F41G 1/467 124/87
5,228,204 A * 7/1993 Khoshnood ..... F41G 1/467 124/87
5,243,957 A * 9/1993 Neilson ..... F41B 5/1469 124/31
5,255,440 A * 10/1993 Rogers ..... F41G 1/467 124/87
5,341,791 A * 8/1994 Shafer ..... F41G 1/345 124/87
5,379,746 A * 1/1995 Sappington ..... F41G 1/467 124/87
5,386,814 A * 2/1995 Denton ..... F41B 5/143 124/44.5
5,400,764 A * 3/1995 Spolar ..... F41G 1/467 124/87
5,413,084 A * 5/1995 Haggard ..... F41G 1/467 124/44.5
5,495,675 A * 3/1996 Huang ..... F41G 1/35 33/DIG. 21
5,507,272 A * 4/1996 Scantlen ..... F41G 1/467 124/87
5,524,601 A * 6/1996 Slates ..... F41B 5/1426 124/87
5,657,740 A * 8/1997 Slates ..... F41G 1/467 124/87
5,850,700 A * 12/1998 Capson ..... F41G 1/467 33/265
6,142,134 A * 11/2000 Meeks ..... F41B 5/143 124/44.5
6,216,681 B1 * 4/2001 Dougherty ..... F41B 5/14 124/88
6,366,344 B1 * 4/2002 Lach ..... G01C 3/10 33/265
6,401,347 B1 * 6/2002 Slates ..... F41G 1/467 33/263
6,430,822 B1 * 8/2002 Slates ..... F41G 1/467 124/87
6,644,297 B1 * 11/2003 Brown, Jr. ..... F41G 1/467 124/87
6,889,683 B1 * 5/2005 Smith ..... F41B 5/14 124/87
7,066,165 B2 * 6/2006 Perry ..... F41B 5/10 124/88
7,328,515 B2 * 2/2008 Helm ..... F41G 1/467 124/87
7,347,196 B1 * 3/2008 Shepley, Jr. ..... F41G 1/467 124/87
7,401,411 B2 * 7/2008 White ..... F41G 1/467 33/265
7,832,109 B2 * 11/2010 Gibbs ..... F41G 1/467 124/87
8,448,341 B2 * 5/2013 Haney ..... F41G 11/003 124/88
8,584,661 B2 * 11/2013 Oppenheim ..... F41G 1/44 124/87
8,596,256 B2 * 12/2013 McPherson ..... F41B 5/066 224/916
8,776,386 B2 * 7/2014 Kingsbury ..... F41G 1/467 124/87
8,904,655 B1 * 12/2014 Larson ..... F41G 1/467 33/265
9,103,632 B1 * 8/2015 Larson ..... F41G 1/467
9,140,513 B2 * 9/2015 Trpkovski ..... F41B 5/1426
9,383,169 B2 * 7/2016 Donovan ..... F41G 1/345
10,330,424 B2 6/2019 Brown
10,330,425 B2 * 6/2019 Missel ..... F41G 1/467
10,634,448 B2 4/2020 Brown
11,098,975 B2 * 8/2021 Evans ..... F41B 5/1492
2004/0007224 A1 * 1/2004 Brown, Jr. ..... F41G 1/467 124/87
2014/0261354 A1 * 9/2014 Ross, Jr. ..... F41B 5/143 124/88
2020/0208938 A1 7/2020 Brown

* cited by examiner

BOW SIGHT ADAPTED TO CONNECT TO CENTER LINE PLANE OF RISER

This application claims priority to U.S. PROVISIONAL Patent Application Ser. No. 62/871,839, filed Jul. 9, 2019.

TECHNICAL FIELD

This invention generally relates to an accessory for an archery bow with a handle riser, namely a bow sight adapted to connect to the handle riser in a center line plane of the riser.

BACKGROUND OF THE INVENTION

Archery bows include risers 10, which generally form a central body of the bow. With reference to the prior art of FIG. 1, these risers 10 may include an upper end 12 and a lower end 14, which may have limb attachment points where cams may be located. A handle 16 may be positioned between the upper and lower ends for gripping by a user during use.

A sight window 20 may be included above the handle 16, which may provide a location from which an arrow is shot from the bow. The sight window 20 may include a lower wall 22, which is sometimes referred to as an arrow shelf, and may further include at least one vertical wall 24, which in turn may connect to an upper wall 26. The upper wall 26 may be horizontal, may project at an angle upward from horizontal, or may be curved. The upper wall 26 may connect the sight window 20 to the upper end 12 of the riser 10.

As can be seen in the prior art of FIG. 2, the riser 10' may be in the form of a shoot-through riser, which may include two vertical walls 24*a*, 24*b*, that may connect the lower wall 22 to the upper wall 26. In such an embodiment, the sight window 20 may be considered a closed configuration, as opposed to the embodiment of FIG. 1, which includes only a single vertical wall 24, and would be considered to have an open configuration.

Accessories such as arrow rests, sights, cable guards, range finders, scopes, flashlights, cameras, fishing reels, and stabilizers are often attached to the riser, such as by way of the vertical wall 24. This is often accomplished through the use of one or more attachment means, such as a hole, on the vertical wall 24. For example, in some instances, a Berger hole is used to mount an arrow rest. The sizes of these holes and thread specifications may be based on Archery Manufacturers' Organization (AMO) standards.

The accessories may be fastened from the outside of the vertical wall 24 of the sight window. In one aspect, accessories for a traditional bow sight mount may mount on the outside of the bow riser, usually on the vertical wall, such as just above the Berger hole. The traditional bow riser may have a series of apertures, such as threaded apertures (AMO standard) to which the sight mount or sight mount bracket may be mounted.

Typical bow sights may have both vertical and horizontal adjustments. For example, in a typical target sight may comprise a bar that may be approximately 6 to 9 inches in length. A first end of the bar may be adapted to mount to the vertical side wall of the riser, such as via one or more threaded apertures or other mounting device. A second end of the bar may comprise a track, carriage, or slide bar allowing for either vertical adjustment (i.e. elevation) or horizontal adjustment (i.e. windage). Attached to the track, carriage, or slide bar may be an attachment point, such as a threaded rod or groove, which is adapted to allow a mounting block or sight mounting block to be fixedly attached. The mounting block or sight mounting block may therefore be adapted for vertical and/or horizontal adjustment.

The mounting block or sight mounting block may have different receivers for attaching a sight. The receiver(s) in the sight mounting block may be adapted to allow horizontal movement of the sight, usually by means of another threaded aperture or groove in which the sight is inserted. A sight may comprise a single sight pin, a scope housing with a single sight pin or a housing with multiple sight pins. Other types of sights are cross-hair and fiber optic.

In terms of adjustment, typical target sights may be adapted for macro-adjustment in a vertical direction to account for elevation changes. This macro-adjustment indicates that travel of the sight or sight mounting block in a vertical direction may be over a relatively long distance (e.g. approximately 2-4 inches) by way of elevation adjustment, such as via the track, carriage, or slide bar. This macro-adjustment allows for the user to set the sight for arrow use over large distances, such as between 10 to 70 yard adjustment away from the user.

In one aspect, the vertical adjustment for elevation is done by way of direct manipulation of the vertical position, such as by way of turning a shaft (e.g. a screw) upon which the carriage may ride. The carriage may slide within a track to prevent movement other than in the vertical direction. In such a configuration, direct manipulation signifies that no gearing up or gearing down of the user's actuation is utilized in the macro-adjustment in the vertical direction.

Horizontal adjustment of the sight or sight mounting block, on the other hand, may be adapted for micro-adjustment in a horizontal direction to account for windage. This micro-adjustment indicates that travel of the sight or sight mounting block in a horizontal direction may be over a relatively shorter distance than the vertical direction (e.g. less than 2 inches) by way of adjustment for windage. This may include a micro-click adjustment that moves the sight or sight mounting block left or right in very small increments.

In one aspect, horizontal adjustment for windage is done by way of indirect manipulation of the horizontal position. This means that manipulation of an adjusting knob may be "geared down" such that a relatively course or significant rotation of the adjusting knob may result in relatively fine adjustment of the sight or sight mounting block in the horizontal direction. When compared with vertical elevation adjustment, the same articulating power or articulating motion from a user of a windage adjusting knob results in a finer adjustment in a horizontal direction, namely an adjustment of the sight or sight mounting block along a much shorter distance.

In the case of mounting a typical accessory, such as a typical sight described herein, certain obstacles are encountered by a user. First, the nature of a sight requires that the sight itself be positioned centrally with respect to the bow riser itself in order for a user to visualize the sight through the sight window 20. Because the sight is attached to the riser along a side wall of the sight window, this requires at least some displacement of the sight in a horizontal direction with respect to the portion of the sight or sight mount which attaches to this sidewall of the riser. For example, in the case of a sight mounted at the end of an arm, the arm normally extends forward from the bow riser in a direction away from the user, with the sight itself the extending laterally (or horizontally) approximately 2-4 inches (depending on the dimensions of the riser itself) to coincide with a user's line of sight through the sight window 20. Stated another way, the arm of a typical sight is not located in or approximately within the centerline plane of the bow riser, but the sight extends horizontally from said arm to be position in or approximately within the centerline plane of the bow riser. This causes unwanted weight which produces an asymmetrically weighted bow. This can force a user to add additional weight in order to counterbalance the weight of the sight (e.g. by way of a side stabilizer, back bar, or a stabilizer weight slide bar), which simply adds additional overall weight to the bow.

Accordingly, a need has been identified for a bow riser with an improved attachment system and corresponding accessories which addresses these and other shortcomings of traditional risers.

SUMMARY OF THE INVENTION

In one aspect of the disclosure, an archery accessory for use with a bow riser is disclosed. The archery accessory includes a sight arm adapted for connecting to the bow riser in a vertical centerline plane of the riser. The archery accessory may include a sight at a distal portion of the sight arm. The sight arm may include a mounting element on a proximal portion of the sight arm adapted for engaging a mount on the riser. In certain embodiments, the archery accessory may include at least one horizontal adjustment system adapted to move the sight in a horizontal direction and at least one vertical adjustment system adapted to move the sight in a vertical direction.

In another aspect, an archery accessory for use with a bow riser including a vertical centerline plane is disclosed. The archery accessory includes an elongated sight arm adapted for connecting to the bow riser at a proximal portion of the sight arm and extending therefrom in a first horizontal direction along a longitudinal axis of the sight arm. A micro-adjust windage system is provided at a distal portion of the sight arm, said micro-adjust windage system being adapted to move horizontally between a first position and a second position in a second horizontal direction perpendicular to the first horizontal direction. In addition, the archery accessory includes an elevational adjustment system adapted to move in a vertical direction and a sight element for use in aiming at a target. The micro-adjust windage system and the elevational adjustment system are adapted to move the sight element horizontally and vertically, respectively. The sight arm is adapted to connect to the bow riser such that the vertical centerline plane is between the first position and the second position.

In certain embodiments, movement of both the micro-adjust windage system and the sight element is limited to between the first position and the second position in the second horizontal direction. In these and other embodiments, the micro-adjust windage system may be distal to the elevational adjustment system. Alternatively, the micro-adjust windage system may be proximal to the elevational adjustment system.

In certain embodiments, the archery accessory may include a second vertical adjustment system, wherein the second vertical adjustment system may be adapted to move the sight element vertically. The second vertical adjustment system may be adapted to impart more fine adjustment of the sight element than the elevational adjustment system. In another aspect, the second vertical adjustment system may comprise a threaded aperture adapted to receive a threaded rod.

In some embodiments, the micro-adjust windage system may comprise a slide, a bolt and carriage, a knob, or a lever. Similarly, the elevational adjustment system may comprise a slide, a bolt and carriage, a knob, or a lever.

In a further aspect of the disclosure, an archery sight for use with a bow riser is disclosed. The archery sight includes an elongated sight arm adapted for connecting to the bow riser at a proximal portion of the sight arm and extending therefrom in a first horizontal direction along a longitudinal axis of the sight arm. A sight element for use in aiming at a target is attached to a distal portion of the sight arm. The archery sight includes a horizontal adjustment system adapted for moving the sight element horizontally between a first position and a second position in a second horizontal direction perpendicular to the first horizontal direction. In addition, the sight includes a first vertical adjustment system adapted for moving the sight element vertically and a second vertical adjustment system adapted for moving the sight element vertically. The second vertical adjustment system is positioned below the first vertical adjustment system and between the first position and the second position in the second horizontal direction.

In certain embodiments, the sight arm may be adapted to connect to the bow riser such that a vertical centerline plane of the bow riser is between the first position and the second position. In some embodiments, the first vertical adjustment may be adapted to impart a greater range of movement of the sight element than the second vertical adjustment.

In these and other embodiments, the horizontal adjustment system may be proximal on the sight arm to the first vertical adjustment system and the second vertical adjustment system, and the horizontal adjustment system may be adapted to move the first vertical adjustment system and the second vertical adjustment system in the second horizontal direction.

In some of these embodiments, the first vertical adjustment system may comprise a slide, a bolt and carriage, a knob, or a lever, and the second vertical adjustment system comprises a threaded aperture adapted for receiving a threaded rod. More specifically, the first vertical adjustment system may comprise a bolt and carriage, and the threaded rod of the second vertical adjustment system includes a longitudinal axis parallel with a longitudinal axis of the bolt of the first vertical adjustment system. The longitudinal axis of the threaded rod may be continuous with the longitudinal axis of the bolt. For example, the threaded rod may be directly below the bolt (or vice versa).

DETAILED DESCRIPTION OF THE INVENTION

The description provided below and in regard to the figures applies to all embodiments unless noted otherwise, and features common to each embodiment are similarly shown and numbered.

Figure 2:
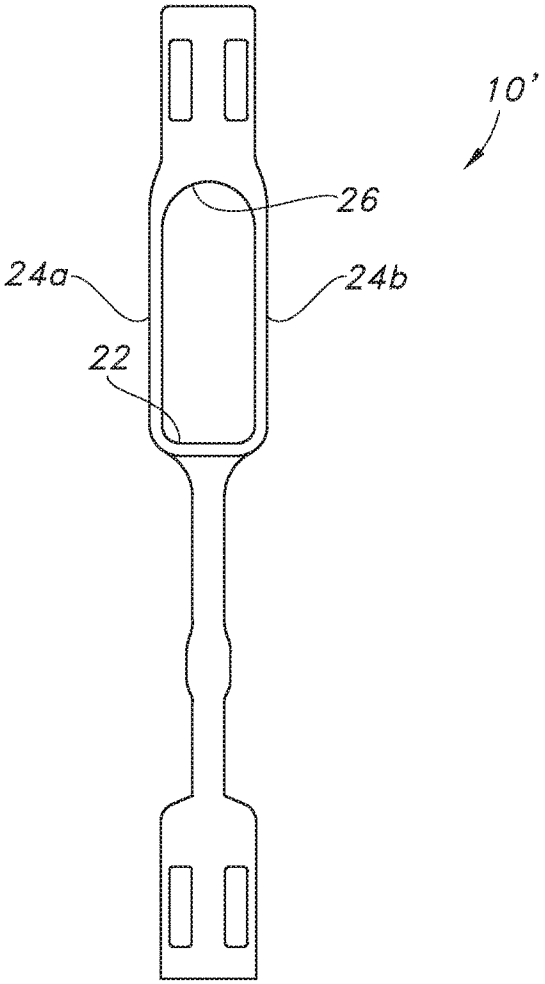
FIG. 2 (Prior Art)
FIG. 2 is a riser of a bow with a sight window including two vertical side walls of the prior art.
Figure 1:
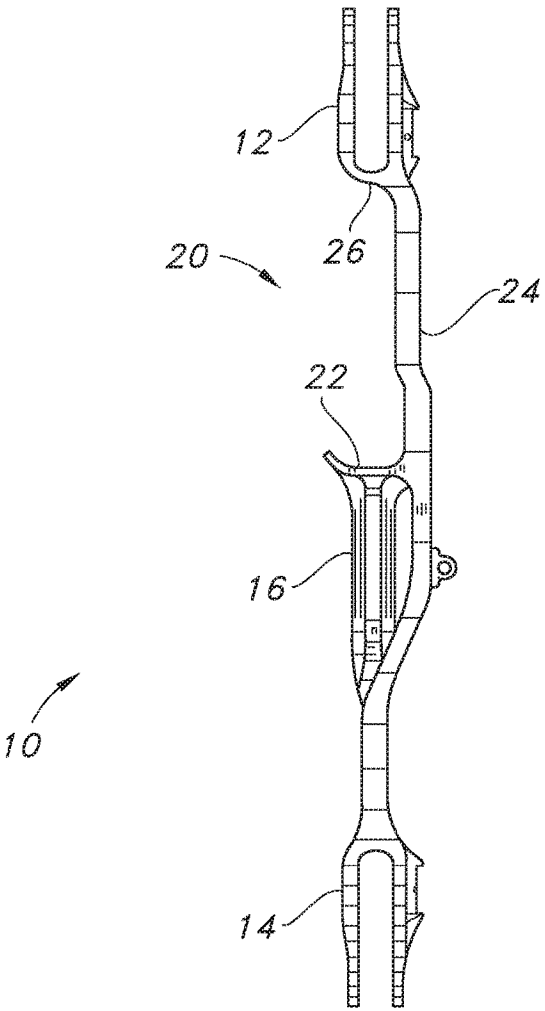
FIG. 1 (Prior Art)
FIG. 1 is a riser of a bow with a sight window including a single vertical side wall of the prior art.
Figure 3:
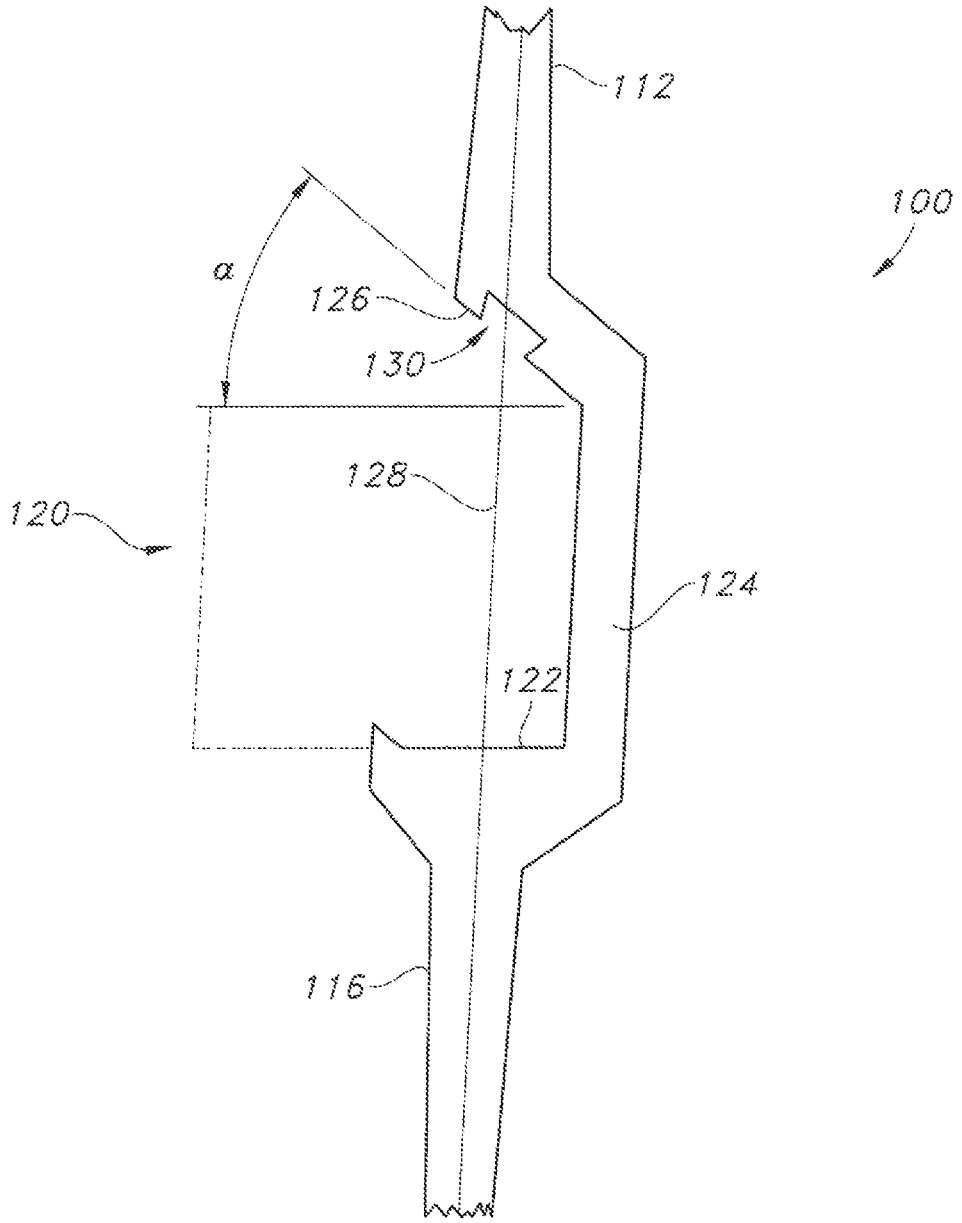
FIG. 3 is a partial rear cross-sectional view of an embodiment of a riser.

With reference to FIG. 3, a riser 100 for an archery bow is illustrated, which includes an upper end 112, and a handle 116, the handle being adapted for a user to grip when firing an arrow. Between the upper end 112 and the handle 116 is a sight window 120. The sight window may be at least partially defined by a lower wall 122, a vertical side wall 124, and an upper wall 126. The lower wall 122 may be referred to as an arrow shelf.

In the illustrated embodiment of FIG. 3, the upper wall 126 may extend away from the vertical side wall 124 at an angle $\alpha$ with respect to horizontal. The angle $\alpha$ may be an angle between 0 and 90 degrees above horizontal, such as between 30 and 45 degrees. Alternately, the angle $\alpha$ may be an angle between 0 and 90 degrees below horizontal. In FIG. 3, the angle $\alpha$ is shown at approximately 40 degrees above horizontal.

The riser 100 may be adapted for use with a bowstring (not pictured), which is adapted to fire the arrow through the sight window 120. A path through which the bowstring travels while firing and arrow may define a centerline plane 128. This centerline plane 128 may generally divide the riser 100 into a left portion and right portion. In one aspect, the centerline plane 128 may divide the riser 100 in half between the left portion and the right portion. As illustrated, the centerline plane 128 extends from a front to a back of the riser 100, and is perpendicular to the plane of the cross-section of the riser 100 as illustrated.

At least one mount 130 may be provided in the upper wall 126 of the sight window. The mount 130 may be positioned at least partially within the centerline plane 128. In one aspect, the mount 130 may be centered within the centerline plane 128. The mount 130 may be adapted to engage an archery accessory and affix the archery accessory to the riser 100. For example, the archery accessory may comprise any of an arrow rest, a sight, a cable guard, a range finder, a scope, a flashlight, a camera, a fishing reel, or a stabilizer. The mount 130 may take one of many forms, such as those outlined below.

Figure 4:
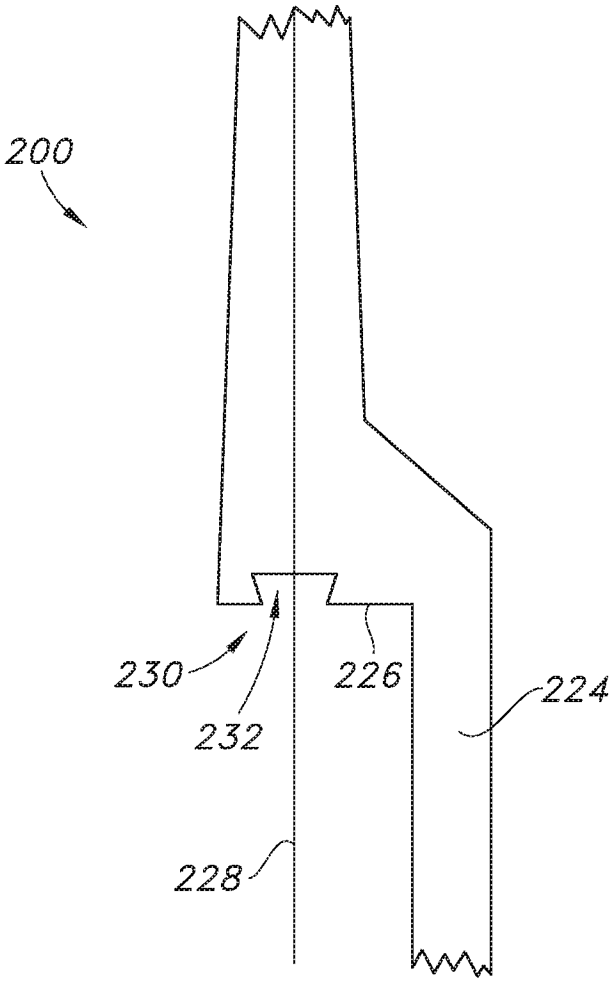
FIG. 4 is a partial rear cross-sectional view of a second embodiment of a riser.

With further reference to FIG. 4, a partial cross-section of a riser 200 is shown, which includes a sight window. A mount 230 may be provided in an upper wall 226 of the sight window. The mount 230 may be located within a centerline plane 228, and may be centered on the centerline plane 228. In the embodiment of FIG. 4, the upper wall 226 is a horizontal wall, and extends approximately 90 degrees from a sidewall 224 of the sight window.

The mount 230 may comprise a recess 232, which is adapted for receiving at least a portion of the archery accessory. For example, the recess 232 may comprise a female connector, which may be adapted to mate with a male connector or extension on the archery accessory. The recess 232 may be a slot or groove running in a direction from a front to a back of the riser, such as along the centerline plane 228. A cross-sectional shape of the recess 232 may be rectangular, trapezoidal, polygonal, or may include a rounded or arcuate cross-section. In one aspect, the recess 232 may comprise a dovetail slot, or may be a slot for receiving a picatinny rail or a weaver rail.

Figure 5:
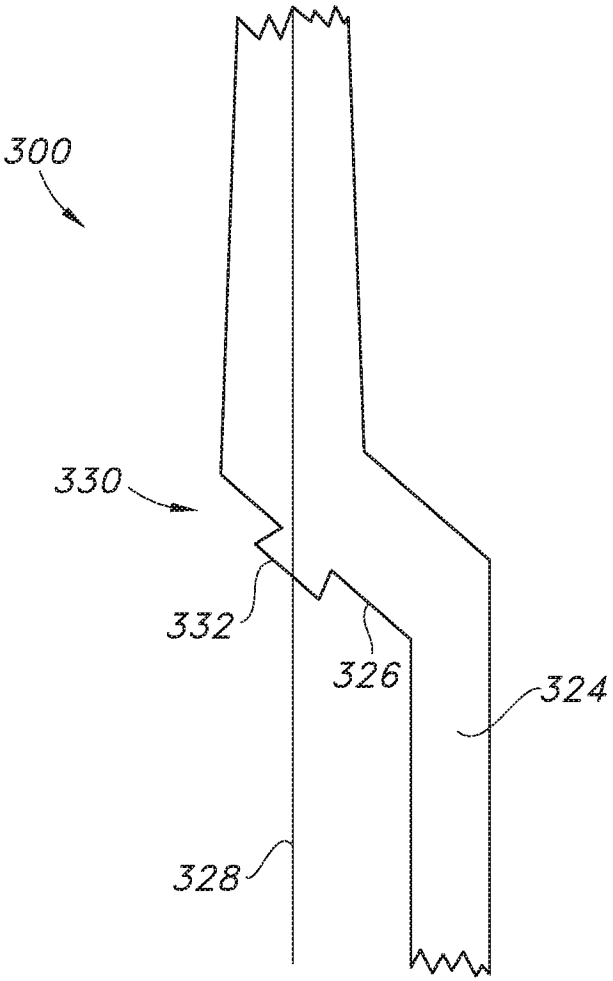
FIG. 5 is a partial rear cross-sectional view of a third embodiment of a riser.

Turning to FIG. 5, a partial cross-section of a riser 300 is illustrated, including a sight window at least partially defined by a vertical side wall 324 and an upper wall 326. As illustrated in FIG. 5, the upper wall may extend from the vertical side wall 324 at an angle $\alpha$ with respect to horizontal.

The upper wall 326 may include a mount 330. The mount 330 may be provided at least partially within the centerline plane 328 of the riser 300. In a further aspect, the mount 330 may be centered within the centerline plane 328. The mount 330 may comprise an extension 332 projecting from the upper wall 326 into the sight window. The extension 332 may run in a direction from a front to a back of the riser, such as along the centerline plane 328. A cross-sectional shape of the extension 332 may be rectangular, trapezoidal, polygonal, or may include a rounded or arcuate cross-section. In one aspect, the extension 332 may comprise a dovetail slide, or may be an extension such as that of a picatinny rail or a weaver rail.

Figure 6:
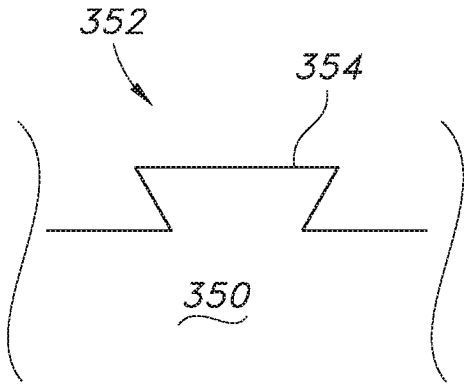
FIGS. 6 and 7 are rear partial cross-sectional views of mounting elements for archery accessories adapted to engage a riser.
Figure 7:
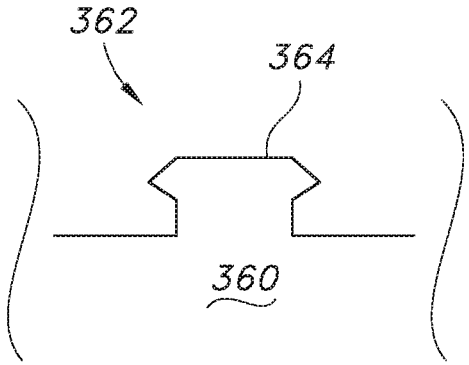

FIG. 6 illustrates a partial cross-section of a first archery accessory 350, which includes a mounting element, such as connector 352, adapted to engage the mount of a riser. The connector 352 is illustrated as a first projection 354, which may be adapted to be received within a recess 232 of a riser 200. The shape of the projection 354 may correspond to a shape of the recess 232, thereby affixing the archery accessory 350 to the riser 200. Similarly, FIG. 7 illustrates a second archery accessory 360, which includes a second mounting element, such as connector 362, in the form of a second projection 364. The second projection 364 may be a different shape than the projection 354 of the first archery accessory 350. As illustrated, the first projection 354 of the first archery accessory 350 is a dovetail slide, while the second projection 364 of the second archery accessory 360 is a picatinny rail slide. A given connector 352, 362, may have a corresponding shape to a recess 232 of a given shape, thereby being specifically adapted to engage a specifically shaped recess.

Similarly, in the case of a mount 330 of a riser 300 being in the form of an extension 332, a corresponding archery accessory may be equipped with a mounting accessory comprising a receiver of a corresponding shape, thereby allowing the extension 332 to engage the receiver of the archery accessory, attaching and fixing the archery accessory to the riser 300.

Figure 8B:
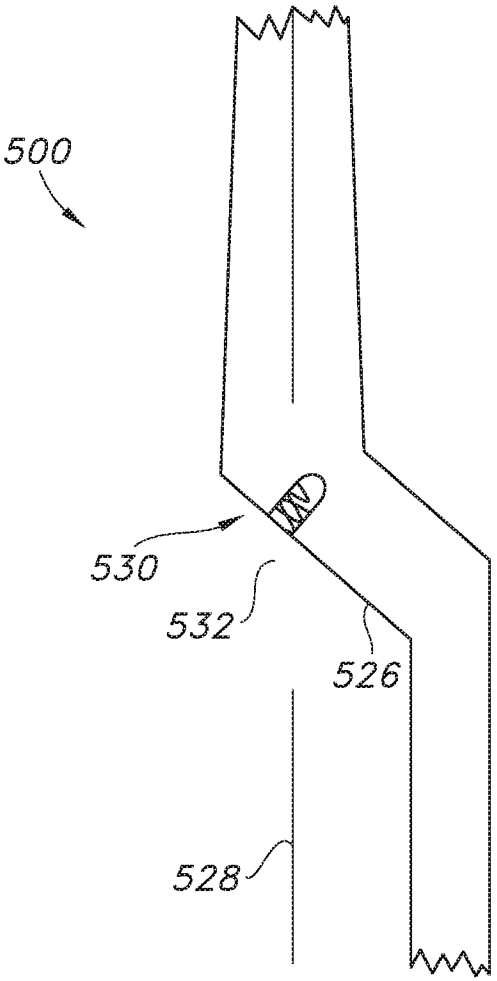
FIGS. 8A and 8B are partial rear cross-sectional views of other embodiments of a riser.
Figure 8A:
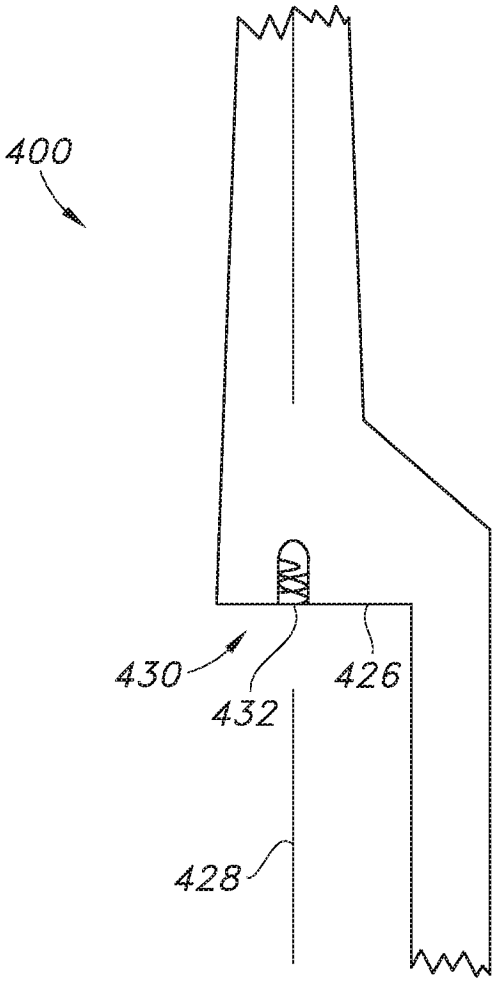

In another aspect, as shown in FIG. 8A, a riser 400 with a sight window at least partially formed by a horizontal upper wall 426, may include a mount 430, which may take the shape of a threaded aperture 432. As with other embodiments, the threaded aperture 432 may be positioned at least partially within a centerline plane 428 of the riser 400, and more specifically may be centered within the centerline plane 428.

FIG. 8B illustrates a similar embodiment to that of FIG. 8A, in which a riser 500 includes a mount 530 in the form of a threaded aperture 532. The threaded aperture 532 may be located at least partially within the centerline plane 528 of the riser 500. The mount 530 may be associated with an upper wall 526 of the sight window, which may project from a vertical side wall of the sight window at an angle $\alpha$ with respect to horizontal.

Figure 9B:
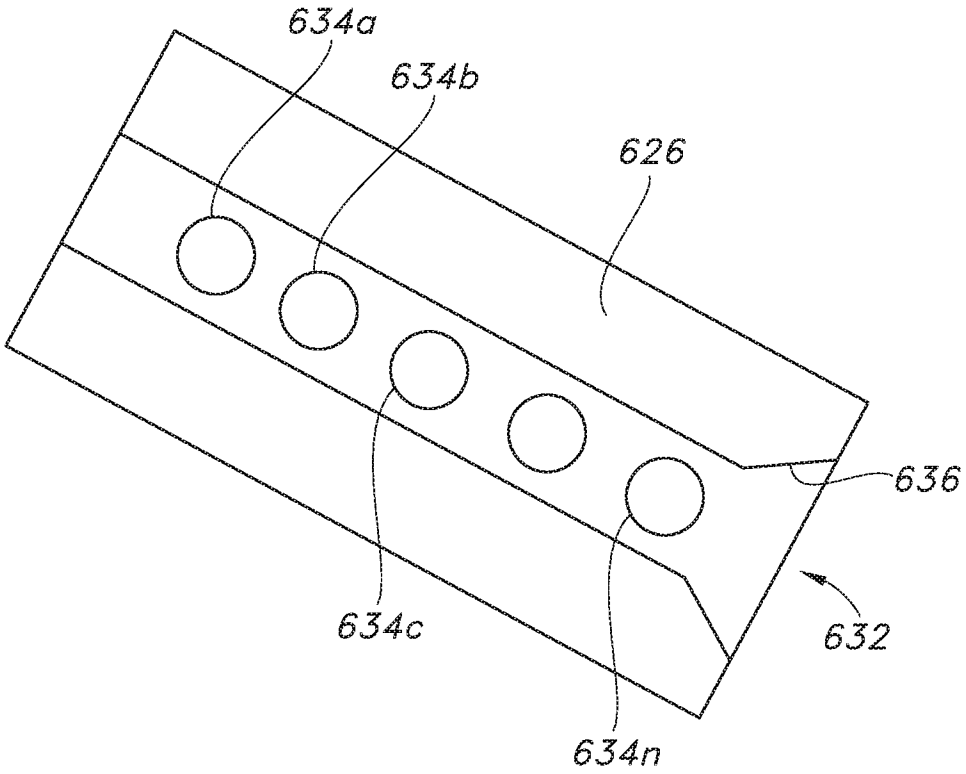
FIG. 9B is a bottom plan view of the mount of FIG. 9A.
Figure 9A:
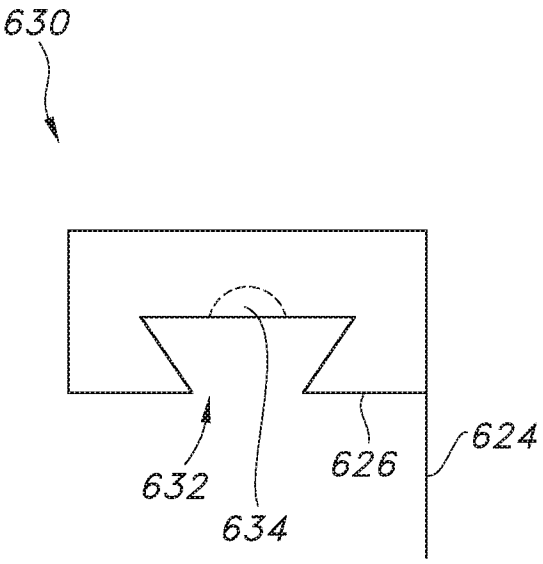
FIG. 9A is a partial rear cross-sectional view of one embodiment of a mount of a riser.

In a further aspect, FIGS. 9A and 9B illustrate a mount 630, which may be provided in an upper wall 626 of a riser. As above, the upper wall 626 of the riser may at least partially define a sight window in combination with at least one vertical side wall 624 of the riser. The mount 630 may comprise a recess 632, which may comprise a cross-sectional shape as disclosed above. As illustrated, the recess 632 may comprise an elongated groove, which may run in a direction from a front to a back of the upper wall, such as along the centerline plane.

In the recess 632, one or more receivers 634 may be provided. The receivers 634 may be adapted to engage the archery accessory and restrict movement of the archery accessory, such as in a direction along the elongated groove. The receiver 634 may comprise an indentation adapted to engage a detent associated with the archery accessory. As shown in FIG. 9B, the receiver may include a plurality of receivers 634*a*, 634*b* . . . 634*n*. This plurality of receivers may allow for selective engagement of a single projecting element of the archery accessory, such as a detent, with an individual receiver in order to select a particular position of the archery accessory along a length of the groove. Alternately, the plurality of receivers may allow for the simultaneous engagement of a plurality of projecting elements from the archery accessory, such as a plurality of detents, in order to more securely fasten the archery accessory to the riser. The elongated groove may further include an opening 636 that may be wider at one point than another, and may be adapted to receive a portion of the archery accessory.

Figure 10B:
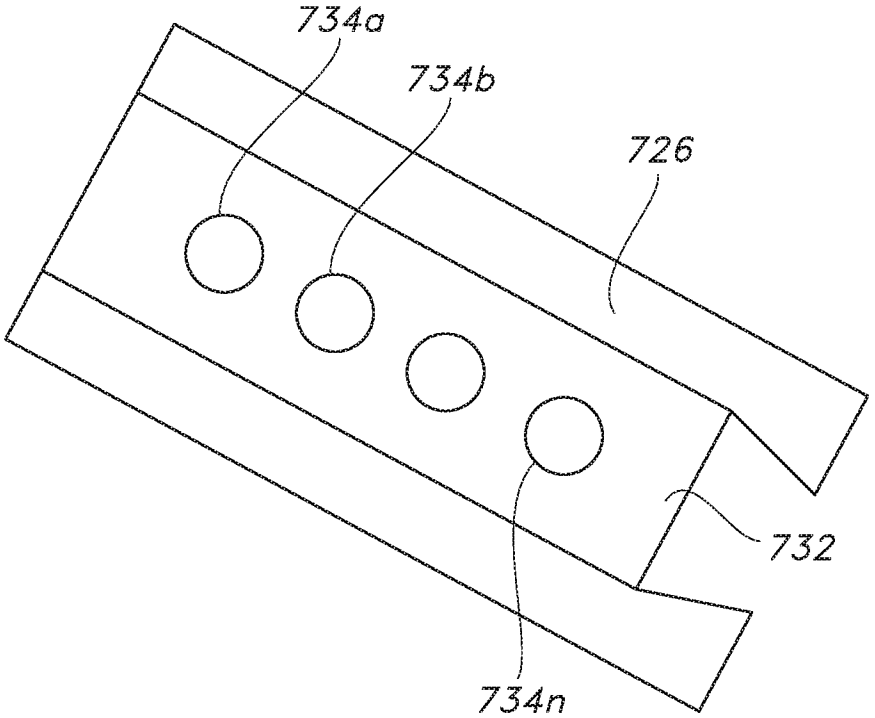
FIG. 10B is a bottom plan view of the mount of FIG. 10A.
Figure 10A:
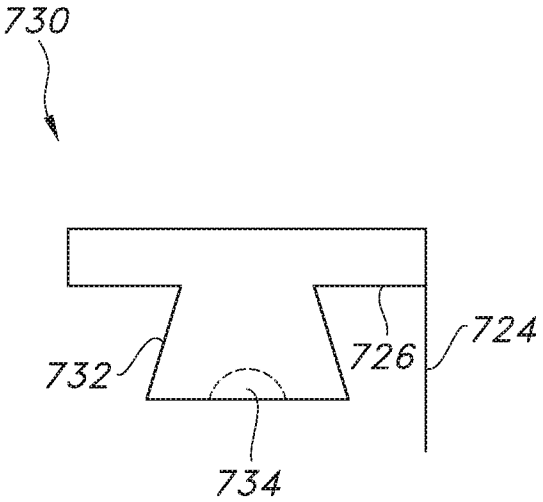
FIG. 10A is a partial cross-sectional view of another embodiment of a mount of a riser.

Similarly, with reference to FIGS. 10A and 10B, a mount 730 is illustrated, which may be provided in an upper wall 726 of a riser. The upper wall 726 may at least partially define a sight window in combination with at least one vertical side wall 724. The mount 730 may comprise an extension 732, which may project from the upper wall 726 into the sight window. The extension 732 may also extend in a direction running from front to back of the upper wall 726, such as along the centerline plane.

The extension 732 may include one or more receivers 734, which may be adapted to engage the archery accessory and restrict movement of the archery accessory, such as in a direction along the centerline plane. The receiver 734 may comprise an indentation adapted to engage a detent associated with the archery accessory. As shown in FIG. 10B, the receiver may include a plurality of receivers 734*a*, 734*b*, . . . 734*n*. This plurality of receivers may allow for selective engagement of a single projecting element of the archery accessory, such as a detent, with an individual receiver in order to select a particular position of the archery accessory along a length of the extension 732 from the front to back of the riser. Alternately, the plurality of receivers may allow for the simultaneous engagement of a plurality of projecting elements from the archery accessory, such as a plurality of detents, in order to more securely fasten the archery accessory to the riser.

Figure 11B:
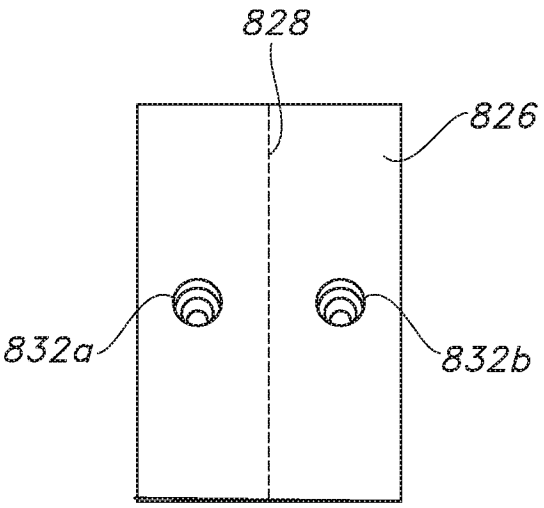
FIG. 11B is a bottom view of a mount of the riser of FIG. 11A.
Figure 11A:
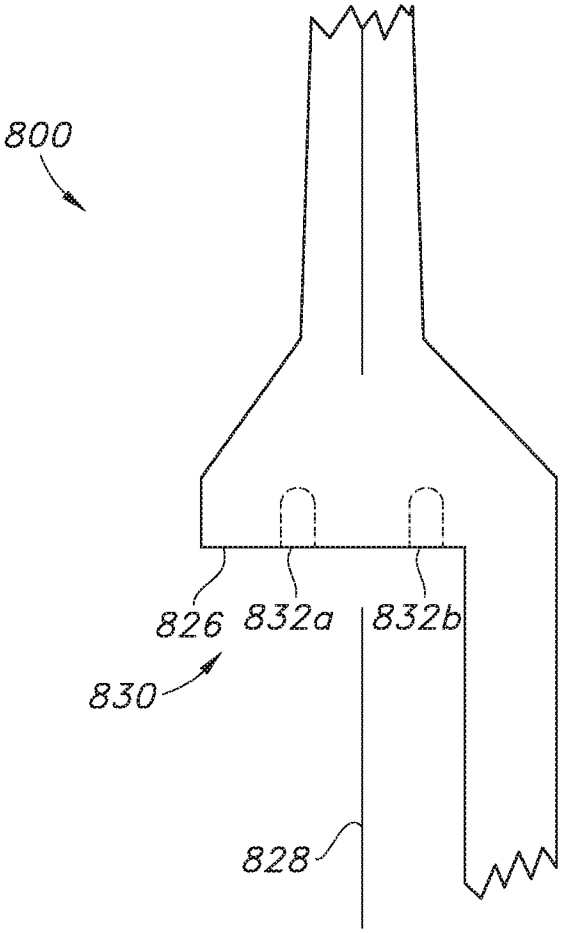
FIG. 11A is a partial rear cross-sectional view of a further embodiment of a riser.

With reference to FIGS. 11A and 11B, a further aspect of a riser 800 is illustrated, wherein a mount 830 may be provided in the upper wall 826 of a sight window of the riser. The mount 830 may comprise a plurality of apertures 832*a*, 832*b*, which may be positioned symmetrically with respect to a centerline plane 828 of the riser 800. As shown, two apertures 832*a*, 832*b* are present, with each of the apertures being equidistant from the centerline plane 828. In one aspect, the plurality of apertures 832*a*, 832*b* may be threaded apertures. The apertures 832*a*, 832*b* may be adapted to engage projections, such as posts or threaded screws, from the archery accessory.

Figure 12B:
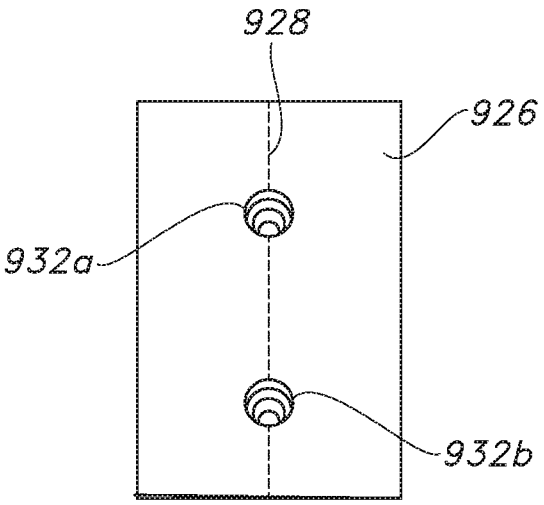
FIG. 12B is a bottom view of a mount of the riser of FIG. 12A.
Figure 12A:
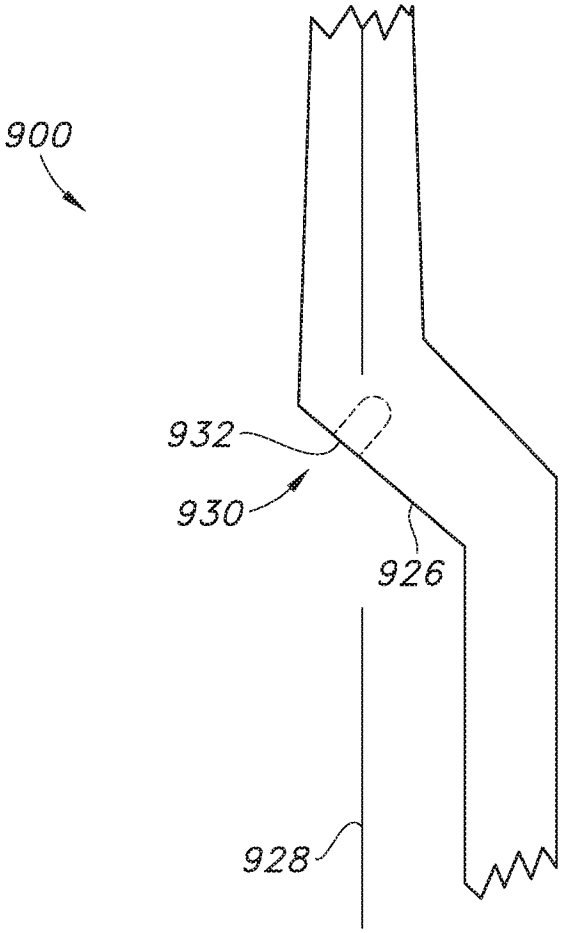
FIG. 12A is a partial rear cross-sectional view of another embodiment of a riser.

Similarly, FIGS. 12A and 12B illustrate a similar embodiment of a riser 900, which includes a mount 930 in an upper wall 926, said mount 930 comprising a plurality of apertures 932*a*, 932*b*. The apertures 932*a*, 932*b* may be positioned along the centerline plane 928 of the riser 900. As can be seen in FIG. 12B, each of the plurality of apertures 932*a*, 932*b* may be positioned within the centerline plane 928. In one aspect, the plurality of apertures 932*a*, 932*b* may be threaded apertures. The apertures 932*a*, 932*b* may be adapted to engage projections, such as posts or threaded screws, from the archery accessory.

Figure 13:
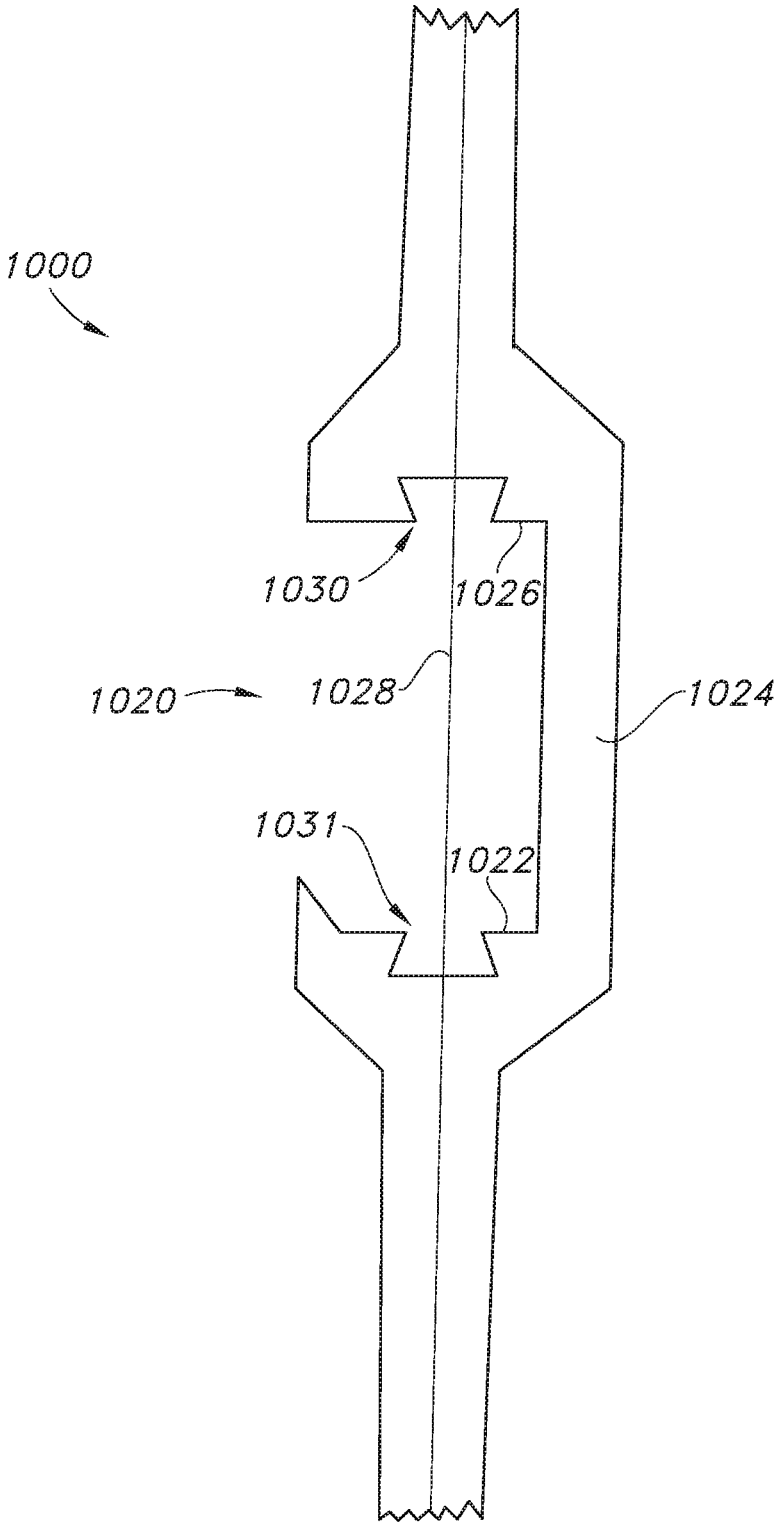
FIG. 13 is a partial rear cross-sectional view of an additional embodiment of a riser.

Turning to FIG. 13, a riser 1000 is depicted, which includes a sight window 1020, which is at least partially defined by a lower wall 1022, at least one vertical side wall 1024, and an upper wall 1026. As in other embodiments, a first mount 1030 may be provided in the upper wall 1026. In addition, at least one second mount 1031 may be provided in the sight window. As shown, the at least one second mount 1031 may be provided in the lower wall 1022. One or both of the first mount 1030 and the second mount 1031 may be provided at least partially within the centerline plane 1028 of the riser 1000. Alternately, the second mount 1031 could be provided in the at least one vertical side wall 1024. Each of the first mount 1030 and the second mount 1031 may be of the configuration of any of the mounts described herein.

Figure 14:
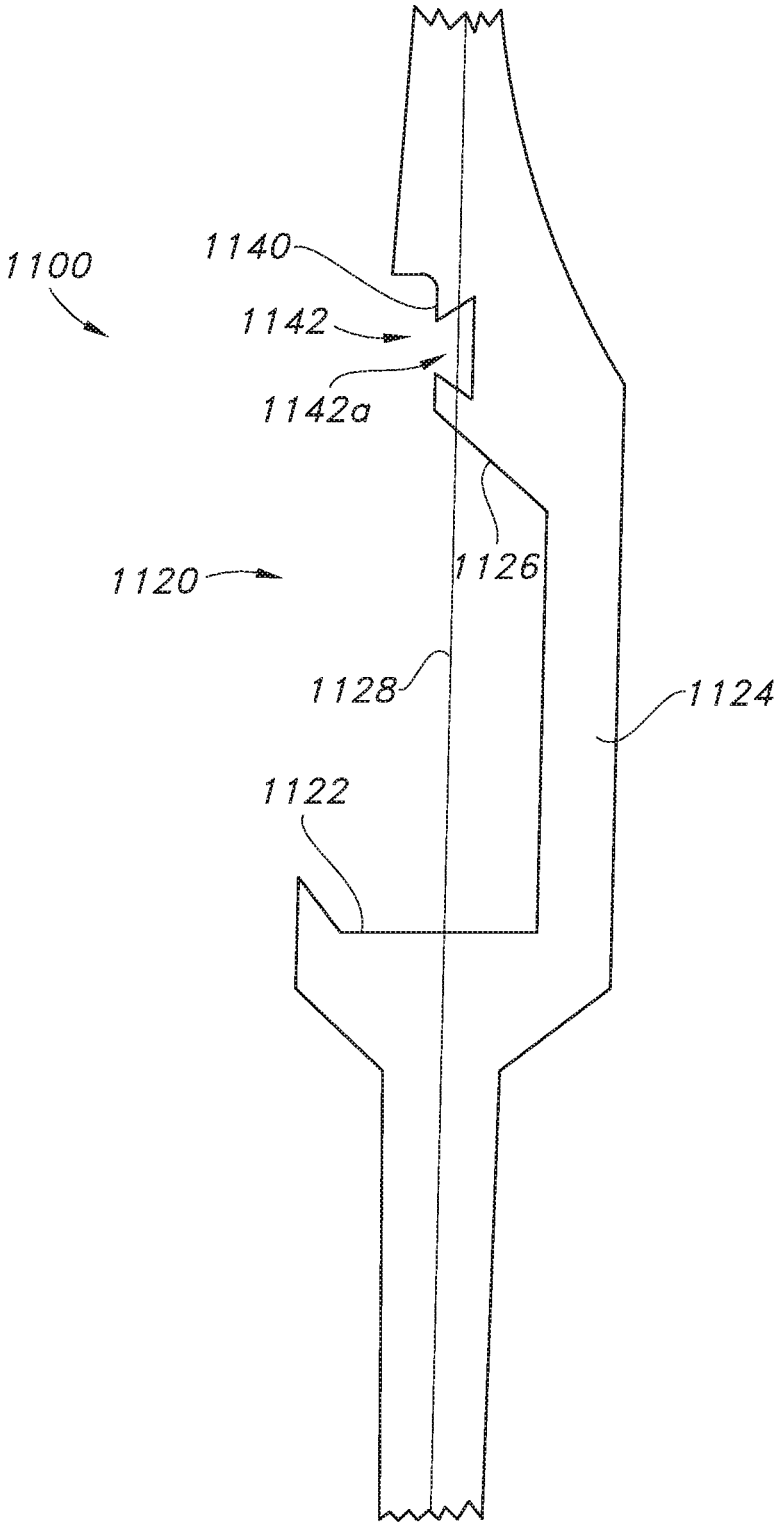
FIG. 14 is a partial rear cross-sectional view of an embodiment of a riser with a second vertical wall including a mount.

In another aspect, a riser may include a mount outside the sight window, but at least partially overlapping with a centerline plane of the riser. As illustrated in FIG. 14, a riser 1100 is illustrated, which includes a sight window 1120, defined at least partially by a lower wall 1122, a first vertical side wall 1124 of the sight window, and an upper wall 1126. The upper wall 1126 may extend away from the first vertical side wall 1124 at an angle α with respect to horizontal. The angle α may be an angle between 0 and 90 degrees above horizontal, such as between 30 and 45 degrees. Alternately, the angle α may be an angle between 0 and 90 degrees below horizontal. In FIG. 14, the angle α is shown at approximately 40 degrees above horizontal.

The riser 1100 may further include a second vertical wall 1140 outside the sight window 1120. The second vertical wall 1140 may be above the sight window 1120 (as shown in FIG. 14) or below the sight window 1120. In one aspect, the upper end of the riser 1100 may include left and right lateral walls and a pocket. The pocket may be at least partially defined by the second vertical wall 1140, which may be a vertical pocket wall. The vertical pocket wall may be closer to a centerline plane 1128 of the riser 1100 than are the left and right lateral walls of the upper end. As illustrated, the pocket may be immediately above the sight window 1120.

The second vertical wall 1140 may include a mount 1142. The mount 1142 may be located above the sight window 1120, and may be at least partially within the pocket. The mount 1142 may be positioned at least partially within the centerline plane 1128. In one aspect, the mount 1142 may be centered within the centerline plane 1128. The mount 1142 may be similar to other mounts outlined herein, and may be adapted to engage an archery accessory and affix the archery accessory to the riser 1100. For example, the archery accessory may comprise any of an arrow rest, a sight, a cable guard, a range finder, a scope, a flashlight, a camera, a fishing reel, or a stabilizer. The mount 1142 may take one of many forms, such as those outlined herein.

The mount 1142 may comprise a recess 1142*a*, which is adapted for receiving at least a portion of the archery accessory. For example, the recess 1142*a* may comprise a female connector, which may be adapted to mate with a male connector or extension on the archery accessory. The recess 1142*a* may be a slot or groove running in a direction from a front to a back of the riser, such as along the centerline plane 1128. A cross-sectional shape of the recess 1142*a* may be rectangular, trapezoidal, polygonal, or may include a rounded or arcuate cross-section. In one aspect, the recess 1142*a* may comprise a dovetail slot, or may be a slot for receiving a picatinny rail or a weaver rail.

The recess 1142*a* associated with the second vertical wall 1140 may take a similar form to those described above with respect to FIGS. 9A and 9B. For example, the recess 1142*a* may comprise an elongated groove, which may run in a direction from a front to a back of the second vertical wall 1140, such as along the centerline plane 1128. The recess 1142*a* may include one or more receivers along the elongated groove which may be adapted to engage the archery accessory and restrict movement of the archery accessory, such as in a direction along the elongated groove. The receiver 1142*a* may comprise one or more indentations adapted to engage one or more detents associated with the archery accessory as shown and described with respect to FIG. 9B. Furthermore, as illustrated in FIG. 9B, the elongated groove of recess 1142*a* may further include an opening that may be wider at one point than another, and may be adapted to receive a portion of the archery accessory.

Figure 15:
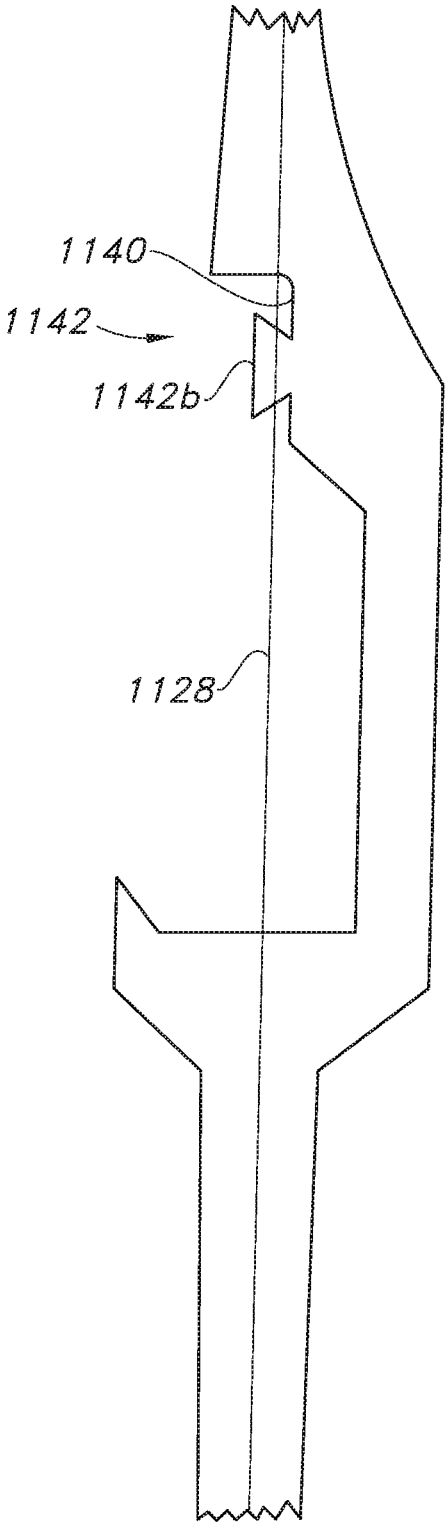
FIG. 15 is another embodiment of the riser of FIG. 14.

With further reference to FIG. 15, the mount 1142 in the second vertical wall 1140 above the sight window may comprise an extension 1142*b*. As illustrated, the extension 1142*b* may be provided at least partially within the centerline plane 1128 of the riser 1100. In one aspect, the extension 1142*b* may be centered within the centerline plane 1128. The extension 1142*b* may run in a direction from a front to a back of the riser, such as along the centerline plane 1128. A cross-sectional shape of the extension 1142*b* may be rectangular, trapezoidal, polygonal, or may include a rounded or arcuate cross-section. In one aspect, the extension 1142*b* may comprise a dovetail slide, or may be an extension such as that of a picatinny rail or a weaver rail.

The extension 1142*b* associated with the second vertical wall 1140 may take a similar form to those described above with respect to FIGS. 10A and 10B. For example, the extension 1142*b* may include one or more receivers along the extension, which may be adapted to engage the archery accessory and restrict movement of the archery accessory, such as in a direction along the centerline plane. The one or more receivers may comprise an indentation adapted to engage a detent associated with the archery accessory, as described and illustrated with respect to FIG. 10B.

Figure 16:
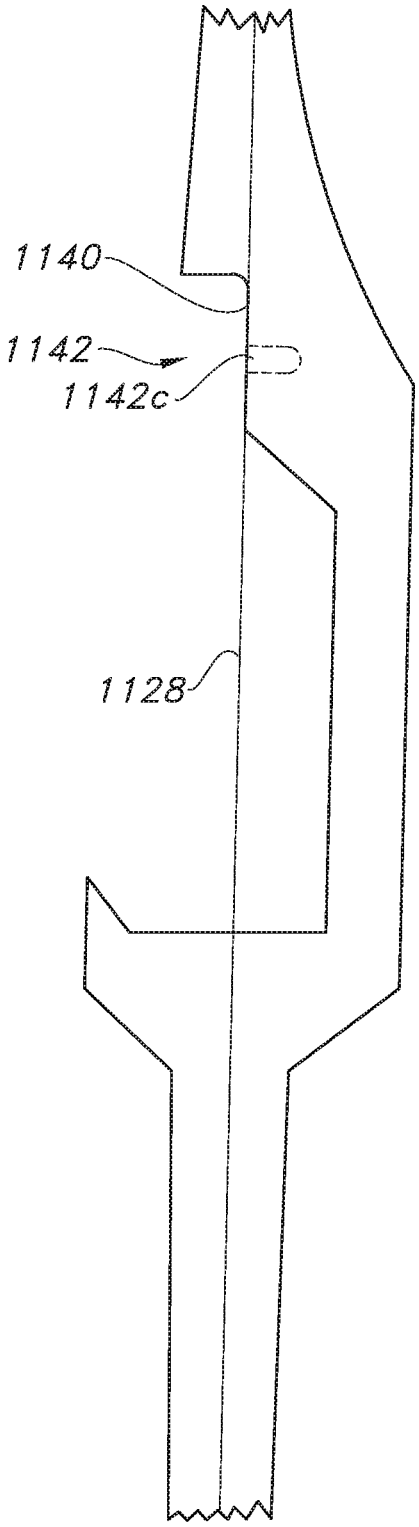
FIG. 16 is a further embodiment of the riser of FIG. 14.

FIG. 16 illustrates a further aspect of the invention. As illustrated, the mount 1142 in the second vertical wall 1140 may comprise a threaded aperture 1142*c*. As with other embodiments, the threaded aperture 1142*c* may be positioned at least partially within or bordering a centerline plane 1128 of the riser 1100, and may be centered within the centerline plane 1128. In one aspect, the threaded aperture 1142*c* may form a cavity that is perpendicular to the second vertical wall 1140.

In one aspect, the threaded aperture 1142*c* in the second vertical wall 1140 may comprise a plurality of threaded apertures, such as those of FIGS. 11A-12B. For example, the second vertical wall 1140 may include a pair of apertures which may be positioned symmetrically with respect to the centerline plane 1128. This may take the form of a pair of threaded apertures that are vertically aligned within the centerline plane 1128, with one above the other. Alternately, this may take the form of a pair of threaded apertures horizontally aligned in the centerline plane, with one forward along the riser 1100 with respect to the other. In any case, the threaded apertures may be adapted to engage projections, such as posts or threaded screws, from the archery accessory.

While not illustrated, the mount 1142 associated with the second vertical sidewall 1140 may be used in conjunction with a mount 1031 in the lower wall, such as is illustrated in FIG. 13.

A riser with a mount for an archery accessory provided within the centerline plane of the riser as described herein may offer advantages over a mount on a side vertical wall of the sight window of the riser. For example, locating and mounting an archery accessory along the centerline plane would prevent unwanted weight positioned off-center with respect to the bow, such as would be the case with mounting of the same accessory along the vertical sidewall of the sight window. Such off-centered weight can interfere with a user's ability to shoot an arrow along a desired path. In addition, the use of a mount aligned with a centerline plane of the riser prevents the need for adding an additional counterbalance weight stabilizer, thereby lowering the overall weight of the bow.

In addition, providing a mount aligning with the centerline plane either in association with the upper wall of the sight window or in association with a vertical wall outside the sight window allows for placement of one or more archery accessories near or within the sight window without interfering with the flight of an arrow, which normally passes at or near the lower wall or arrow shelf. In the embodiment of a mount in both the upper wall (or in association with a second vertical wall above the sight window) and the lower wall, such a riser allows for coordinated location of an upper mount and a lower mount along the centerline plane of the riser. Accordingly, both an arrow rest and an additional archery accessory (e.g. a sight, a light, a camera, etc.) may be aligned with the centerline plane, thereby coordinating the function of two different accessories, while maintaining a balanced center of gravity of the overall bow.

Turning to FIGS. 17-20, an archery accessory for use with a bow riser as described herein is illustrated. The archery accessory may be in the form of a sight 1200, which may be adapted for mounting within or bordering the vertical centerline plane 1228 (or just the "centerline plane") of the riser. In the context of this disclosure, the "centerline plane" may refer to a plane defining a vertical center of mass of the bow or bow riser. The archery accessory may include a mounting element, such as any of the mounting elements described herein, which may be adapted for attaching the archery accessory to a mount of the riser as described herein, such as within the centerline plane 1228.

As illustrated, the archery accessory is a bow sight 1200 adapted for use within or bordering the centerline plane 1228. The sight may be adapted for connecting to the bow riser in the centerline plane 1228. Placement of the bow sight 1200 within the centerline plane may offer advantages disclosed herein, including preventing or reducing the sight from creating unequal weight between left and right sides of the bow.

In one aspect, the bow sight 1200 may include a sight arm 1202 adapted to connect to the bow riser. For example, a proximal portion of the sight arm 1202 may connect to the bow riser, such as via one of the mounting elements described herein. The sight arm 1202 may be adapted for extending from the bow riser in a first horizontal direction, such as along a longitudinal axis of the sight arm 1202.

A sight element 1204 may be provided for use in aiming at a target. In one aspect, the sight element 1204 may be adapted for connecting either directly or indirectly to a distal portion of the sight arm 1202. The sight element 1204 may be moved in vertical and/or horizontal directions in order to adjust for elevation, distance from target, environmental factors such as wind, or other factors. As one option, the sight element 1204 may comprise a sight pin, such as a fiber optic pin. The sight element 1204 may be connected to a sight mounting block 1206, which may provide stability for the sight element 1204. The sight mounting block 1206 may include a window through which the user may view a target, and the sight element may be positioned within the window.

In order to address environmental factors during use or to address a characteristic of the bow itself which may account for left or right drifting of an arrow from an intended target, a horizontal adjustment system 1210 may be provided for adjusting a position of the sight element 1204 in a second horizontal direction perpendicular to the first horizontal direction. In one aspect, the horizontal adjustment system 1210 may be adapted to adjust a position of an entire portion of the sight arm distal to the horizontal adjustment system 1210 in the second horizontal direction.

The horizontal adjustment system 1210 may be in the form of a micro-adjust windage system. In another aspect, the horizontal adjustment system 1210 may comprise a slide, a bolt and carriage, a knob, a lever, or other device adapted to effectuate horizontal motion. In one example, the micro-adjust windage system may be adapted to move the sight element 1204 or the entire portion of the sight arm distal to the horizontal adjustment system 1210 in the horizontal direction by way of turning a knob, such that the sight element 1204 moves approximately $0.5\text{-}1.0\times10^{-4}$ inches in the horizontal direction per degree turn of the knob.

The horizontal adjustment system 1210 may be adapted to move in the second horizontal direction between a first position and a second position. Motion of the horizontal adjustment system 1210 may be limited to motion in the second horizontal direction only between the first position and the second position. In a further aspect, the horizontal adjustment system 1210 may be adapted to limit motion of the sight element 1204 in the second horizontal direction only between the first position and the second position. Upon attachment of the bow sight 1200 to the riser, the horizontal adjustment system 1210 may be adapted to maintain the centerline plane 1228 of the bow riser between the first position and the second position.

A first vertical adjustment system 1208 may be provided for inducing gross movement of the sight element 1204 in a vertical direction. In one aspect, the first vertical adjustment system 1208 may be adapted for inducing gross movement of an entire portion of the sight arm distal to the first vertical adjustment system 1208 in the vertical direction. This gross movement may allow for significantly more range of motion than the movement allowed by the horizontal adjustment system. For example, the first vertical adjustment system 1208 may allow for a traveling distance in the vertical direction that may be two times, three times, or more, than the maximum traveling distance allowed by the horizontal adjustment system 1210 in the horizontal direction.

The first vertical adjustment system 1208 may be in the form of an elevational adjustment system, which may be adapted to account for positioning the sight element 1204 at an appropriate height within a user's line of sight during use. For example, the first vertical adjustment system 1208 may be for the purpose of setting the sight element to correspond to a particular yardage away from the user. This may be from approximately 10-50 yards with respect to hunting sights, and may be from approximately 10 yards to upward of 100 yards for target sights. As with the horizontal adjustment system 1210, the first vertical adjustment system 1208 may comprise a slide, a bolt and carriage, a knob, a lever, or other device adapted to effectuate vertical motion.

In one example, the elevational adjustment system may be adapted to move the sight element 1204 in the vertical direction by way of turning a knob, such that the sight element 1204 moves approximately $6.0\text{-}8.0\times10^{-4}$ inches in the vertical direction per degree turn of the knob. Stated another way, in similar knob-adjustment systems, the elevational adjustment system may be adapted to move the sight element 1204 in a vertical direction 6-16 times further than the micro-adjust windage system is adapted to move the sight element 1204 in the horizontal direction based on similar degrees of knob turning.

In a further aspect, a second vertical adjustment system 1212 may be provided for minor adjustments of the sight element 1204 in the vertical direction. These minor adjustments of the sight element 1204 in the vertical direction may be for the purpose of adjusting the sight element 1204 to account for different distances between the user and a desired target. For example, the second vertical adjustment system 1212 may be adapted for allowing a user to use the sight element 1204 to aim at targets of short distances away, such as 10 yards, to longer distances away, such as 70 yards to 100 yards or more, by adjusting the vertical height of the sight element 1204. In one aspect, movement of the sight element 1204 by the second vertical adjustment system 1212 may be limited to no more than a longitudinal length of the sight element 1204 itself. The second vertical adjustment system 1212 may comprise a slide, a bolt and carriage, a knob, a lever, or other device adapted to effectuate vertical motion. In one aspect, the second vertical adjustment system 1212 may comprise a threaded aperture adapted to receive a threaded rod member.

Figure 17:
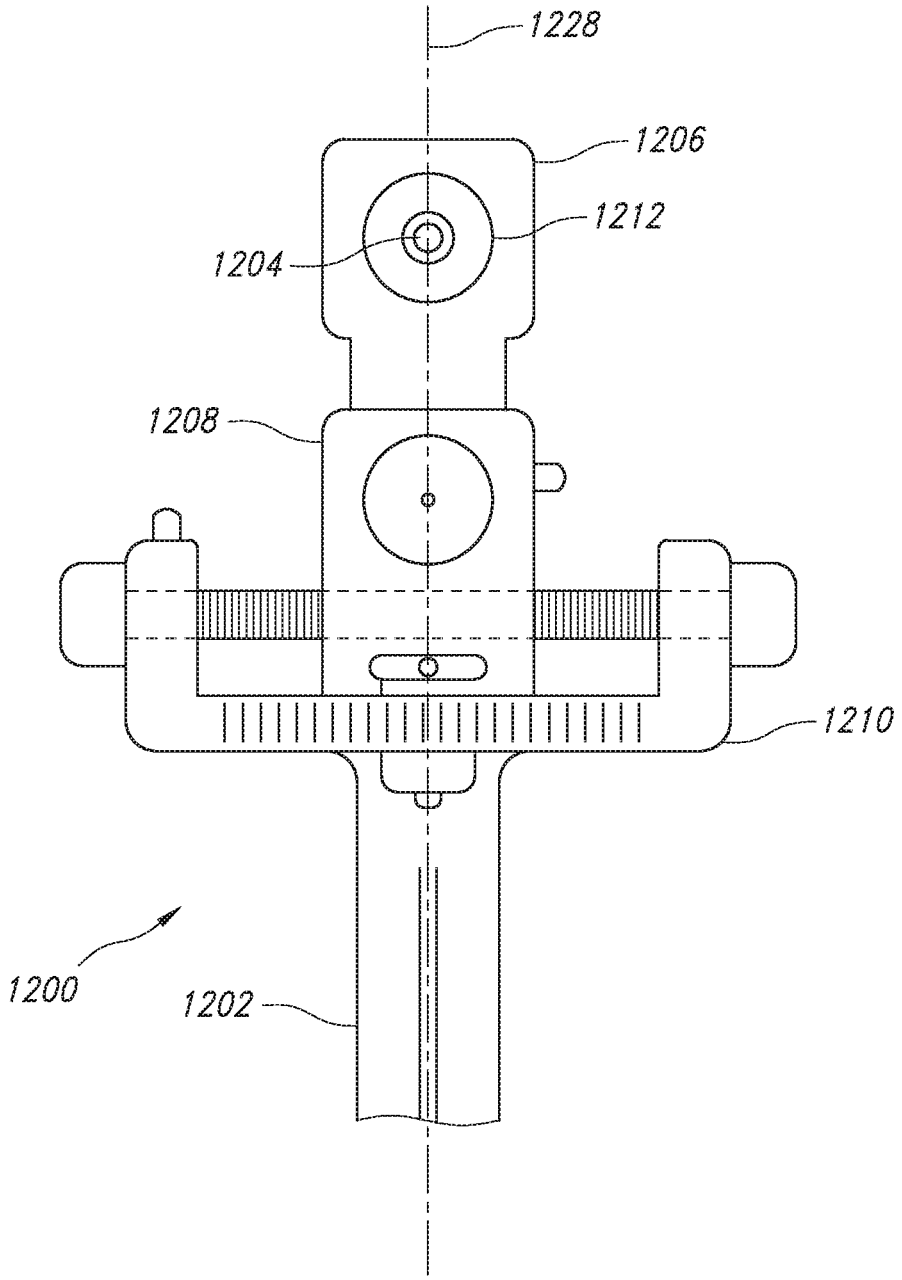
FIG. 17 is a top plan view of a first embodiment of an archery accessory adapted for attachment to a bow riser.
Figure 18:
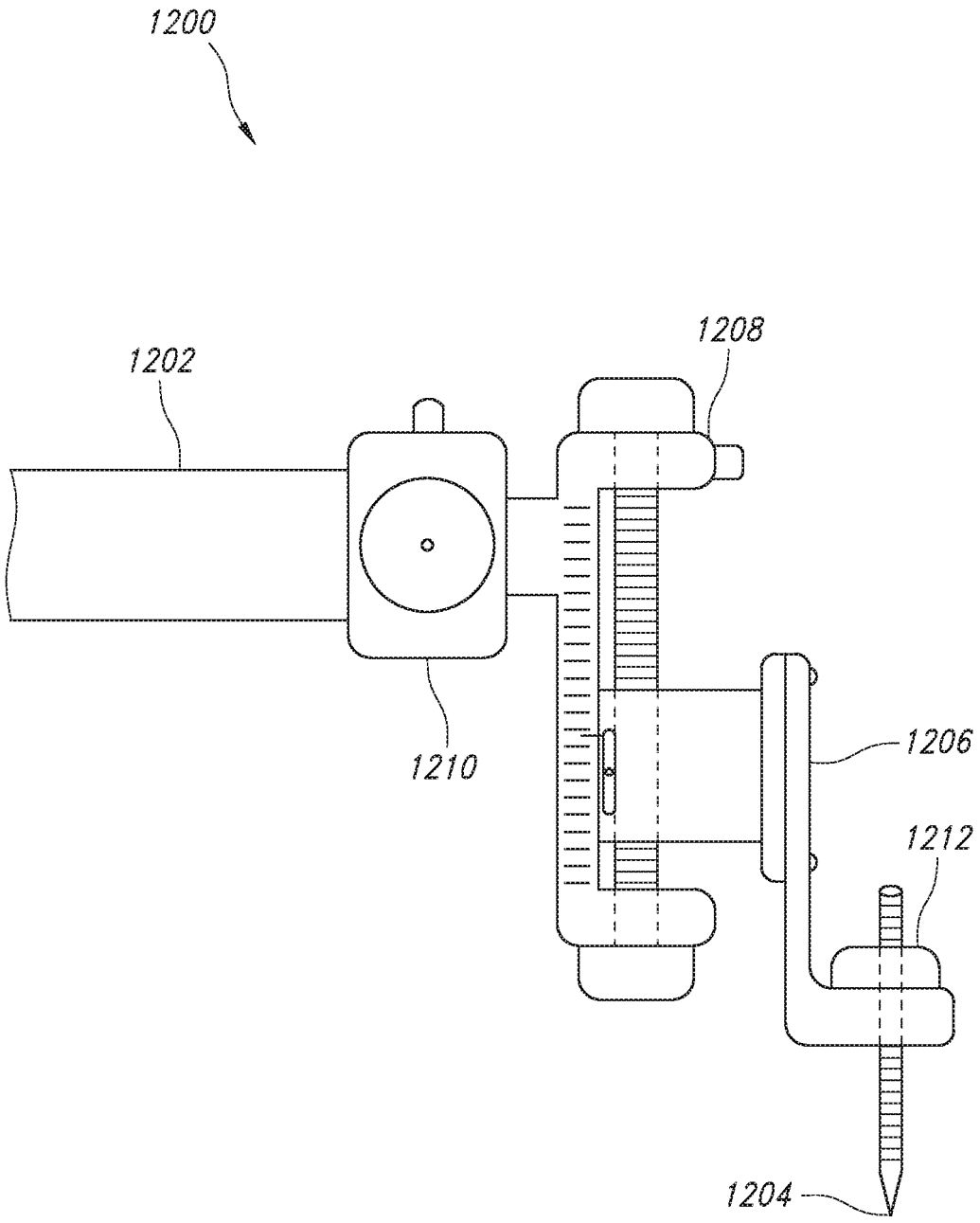
FIG. 18 is a side elevational view of the archery accessory of FIG. 17.

In one embodiment, as illustrated in FIGS. 17 and 18, the first vertical adjustment system 1208 may be distal to the horizontal adjustment system 1210 with respect to the connection of the sight 1200 to the bow riser. In this embodiment, the horizontal adjustment system 1210 may remain at a fixed position with respect to a proximal portion of the sight arm 1202 which attaches to the riser. The horizontal adjustment system 1210 may be adapted to move the first vertical adjustment system 1208 (and anything else distal to the horizontal adjustment system 1210) in the second horizontal direction, such as between the first position and the second position.

Figure 19:
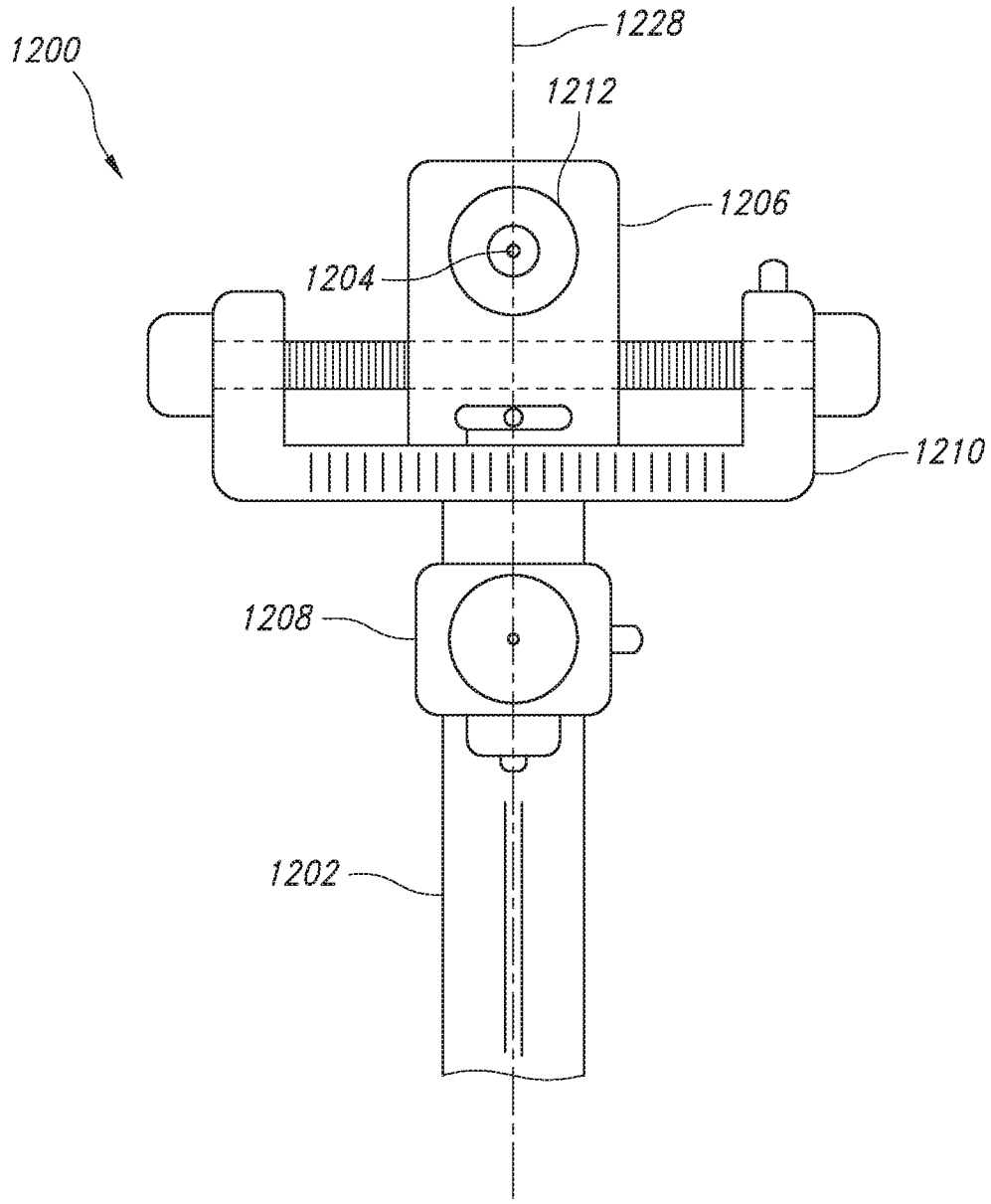
FIG. 19 is a top plan view of a second embodiment of an archery accessory adapted for attachment to a bow riser.
Figure 20:
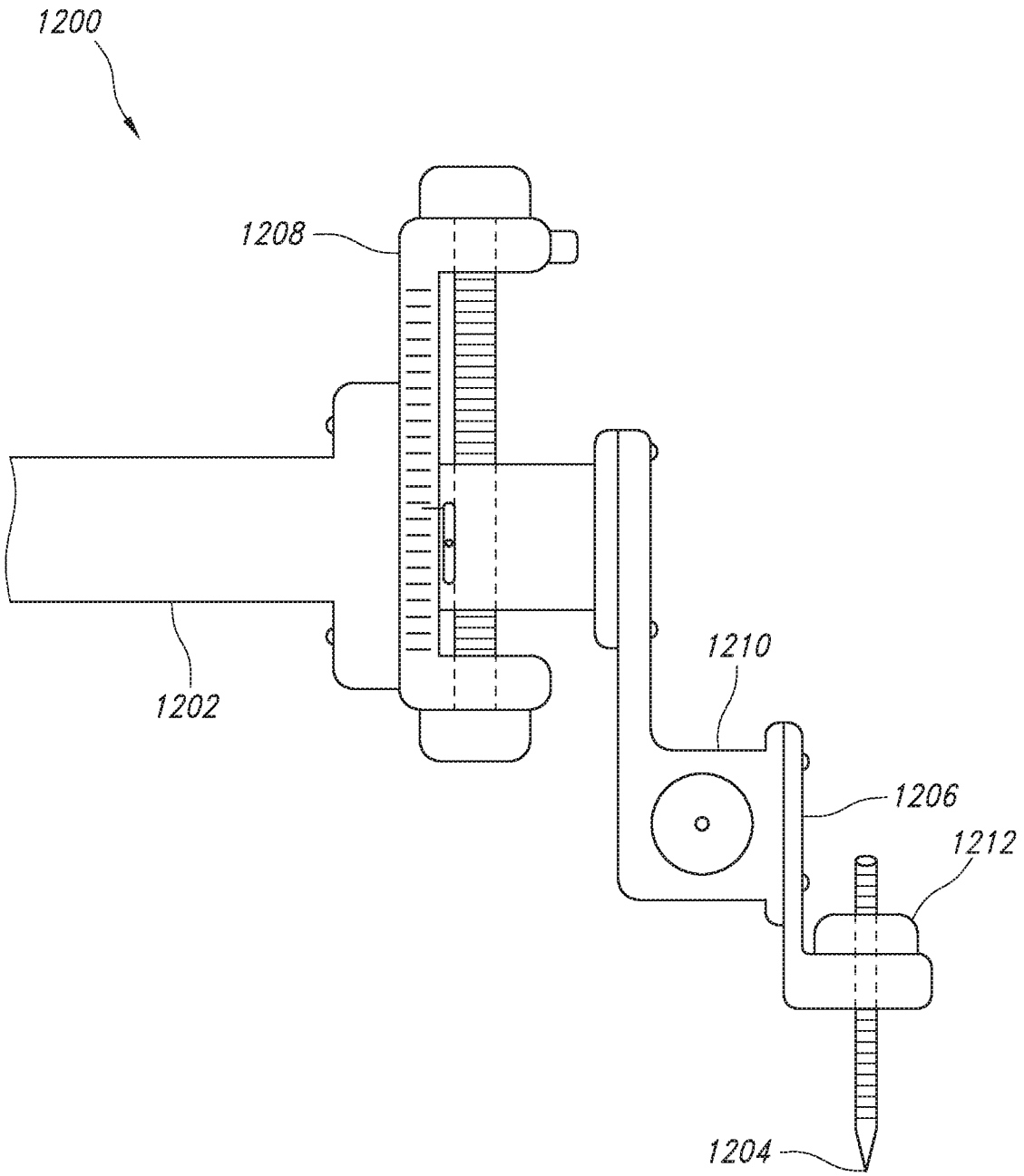
FIG. 20 is a side elevational view of the archery accessory of FIG. 19.

In another embodiment, as illustrated in FIGS. 19 and 20, the first vertical adjustment system 1208 may be proximal to the horizontal adjustment system 1210 with respect to the connection of the sight 1200 to the bow riser. In this embodiment, the first vertical adjustment system 1208 may remain at a fixed position with respect to a proximal portion of the sight arm 1202 which attaches to the riser, such as within the centerline plane 1228 of the bow riser. The horizontal adjustment system 1210 may be adapted to move only elements of the sight 1200 which are distal to the horizontal adjustment system 1210.

In each of the embodiments of FIGS. 17-18 and FIGS. 19-20, the second vertical adjustment system 1212 is distal to the first vertical adjustment system 1208. In addition, the second vertical adjustment system 1212 may be vertically below the first vertical adjustment system 1208. In one aspect, such as in the embodiment of FIGS. 17-18, the second vertical adjustment system 1212 may remain at a fixed position with respect to the first vertical adjustment system 1208 in the horizontal direction. This may be the case in the instance in which there is no horizontal adjustment system between the first vertical adjustment system 1208 and the second vertical adjustment system 1212. Because the horizontal adjustment system 1210 is proximal to both of the vertical adjustment systems 1208 and 1212, each of the vertical adjustment systems 1208 and 1212 may be adapted to move horizontally together. As noted above, this horizontal movement may be minimal and may be limited by the extent to which the horizontal adjustment system 1210 may move, and may encompass the centerline plane 1228 of the bow riser.

In another aspect, such as in the embodiment of FIGS. 19-20, the horizontal adjustment system 1210 may be located between the first vertical adjustment system 1208 and the second vertical adjustment system 1212. Accordingly, second vertical adjustment system 1212 may be adapted to move in a horizontal direction with respect to the first vertical adjustment system 1208. This horizontal movement of the second vertical adjustment system 1212 may be minimal, may be limited by the extent to which the horizontal adjustment system 1210 may move, and may encompass the centerline plane 1228 of the bow riser.

Figure 21:
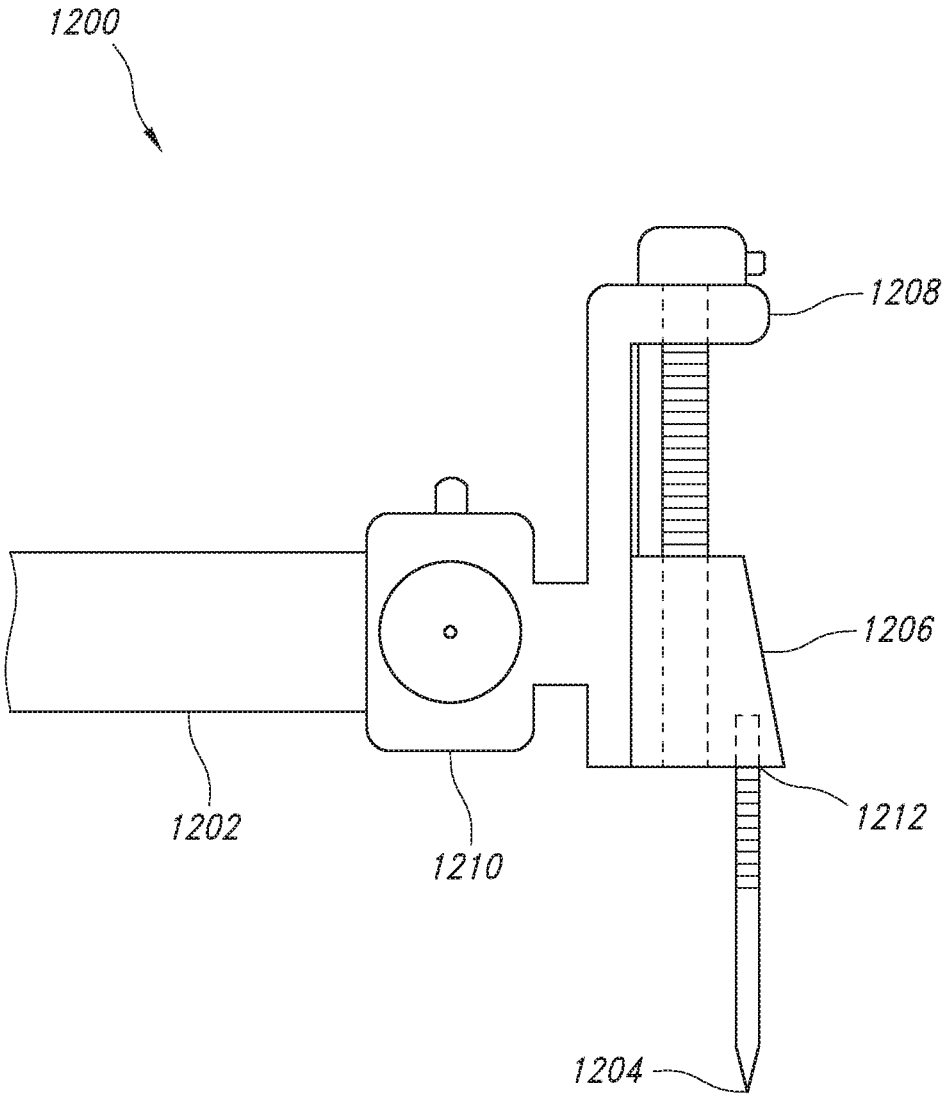
FIG. 21 is a side elevational view of a third embodiment of an archery accessory adapted for attachment to a bow riser.
Figure 22:
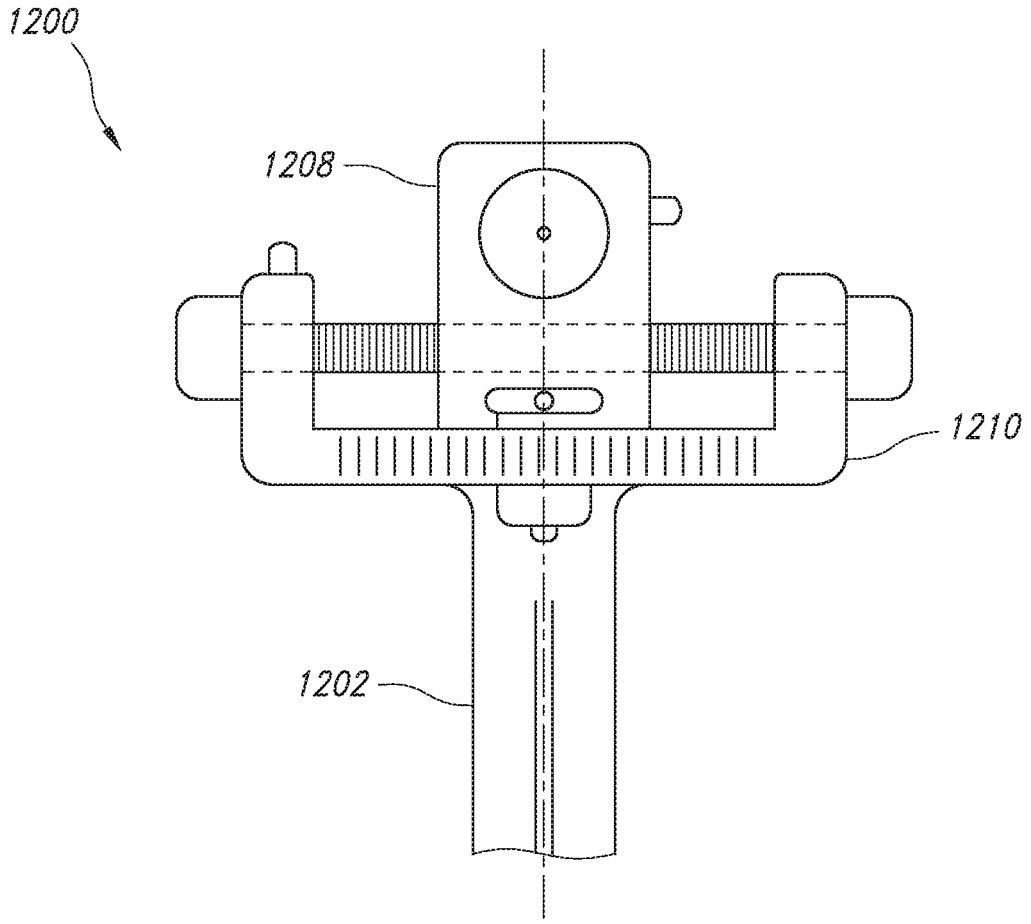
FIG. 22 is a top plan view of the archery accessory of FIG. 21.
Figure 23:
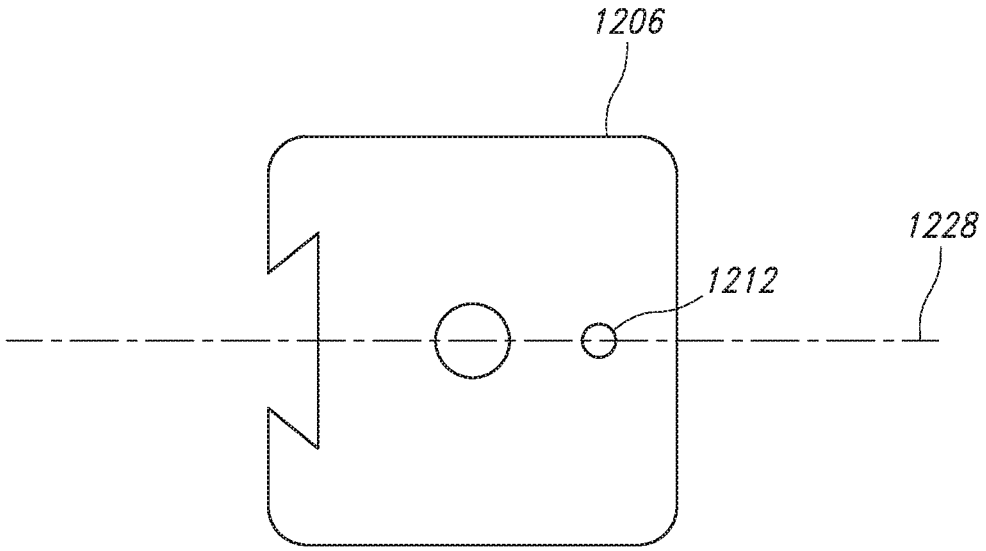
FIG. 23 is a bottom plan view of a sight mounting block of the archery accessory of FIG. 21.

In a further aspect, at least a portion of the first vertical adjustment system 1208 and the second vertical adjustment system 1212 may contact the sight mounting block 1206. With reference to FIGS. 21-23, an embodiment of the archery accessory is disclosed in which both the first vertical adjustment system 1208 and the second vertical adjustment system 1212 are distal to the horizontal adjustment system 1210 along the sight arm 1202. The sight mounting block 1206 may be raised and lowered by or at least partially within the first vertical adjustment system 1208. In one aspect, at least a portion of the first vertical adjustment system 1208, such as a bolt, dowel, or otherwise adjustable rod, may pass at least partially through the sight mounting block 1206. The first vertical adjustment system 1208 may include a first aperture in a lower portion of the sight mounting block 1206.

The second vertical adjustment system 1212 may be associated with a lower portion of the sight mounting block 1206. As illustrated, the second vertical adjustment system 1212 may include a portion that passes at least partially through the sight mounting block 1206. In one aspect, the second vertical adjustment system 1212 may comprise a second aperture, which may be threaded, through which a bolt, dowel, or otherwise adjustable rod may pass. The second aperture may be positioned in the lower portion of the sight mounting block 1206. As can be seen in FIG. 23, the first aperture and the second aperture may be positioned within the centerline plane 1228, at least when the sight mounting block 1206 is horizontally centered in the centerline plane. The second aperture may be distal to the first aperture.

Figure 24:
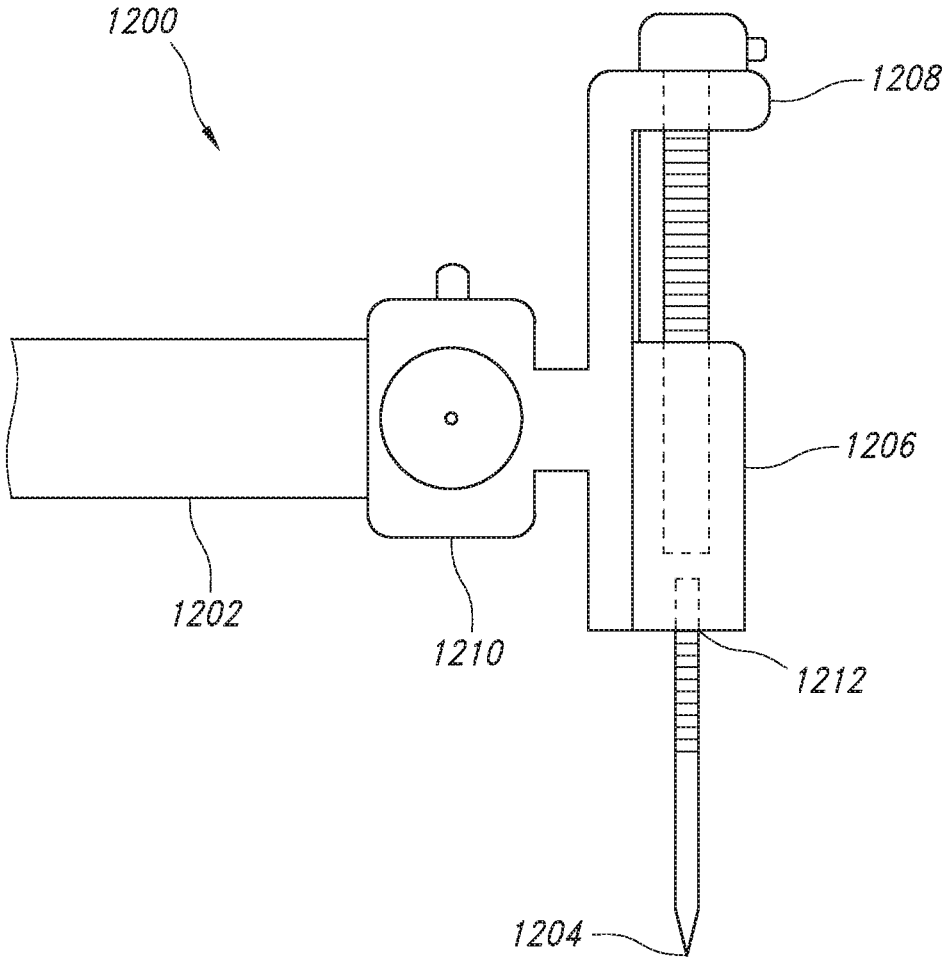
FIG. 24 is a side elevational view of a fourth embodiment of an archery accessory adapted for attachment to a bow riser.
Figure 25:
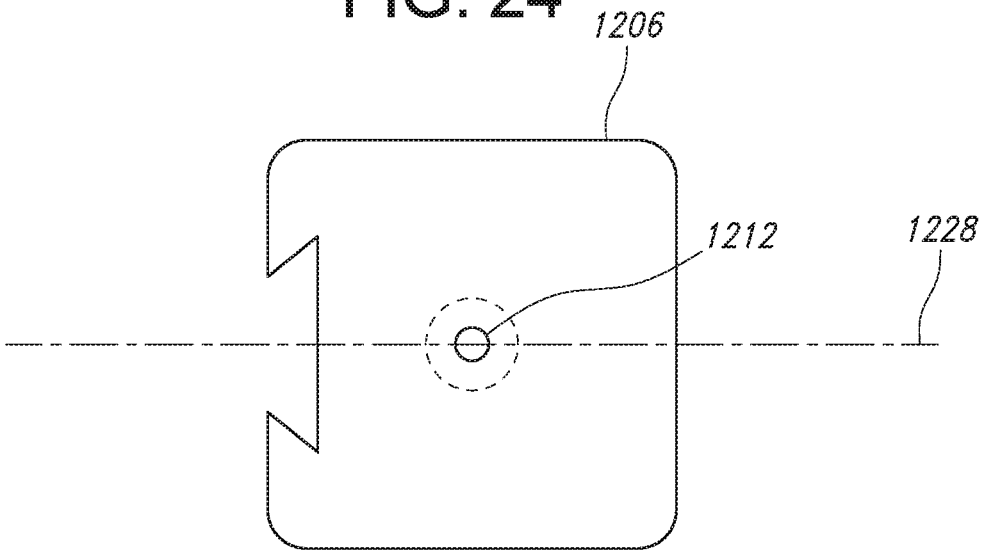
FIG. 25 is a bottom plan view of a sight mounting block of the archery accessory of FIG. 24.

With reference to FIGS. 24-25, the first vertical adjustment system 1208 may be directly above the second vertical adjustment system 1212. The first vertical adjustment system 1208 may include a bolt, dowel, or otherwise adjustable rod which may pass through at least a top portion of the sight mounting block 1206. The second vertical adjustment system 1212 may include a bolt, dowel, or otherwise adjustable rod which may pass through at least a bottom portion of the sight mounting block 1206. As can be seen in FIG. 25, the bolt, dowel, or otherwise adjustable rod of the first vertical adjustment system 1208 may be concentric with or may include a common longitudinal axis with the bolt, dowel, or otherwise adjustable rod of the second vertical adjustment system 1212. This common longitudinal axis may be positioned within the centerline plane 1228, at least when the sight mounting block 1206 is horizontally centered in the centerline plane.

Figure 26:
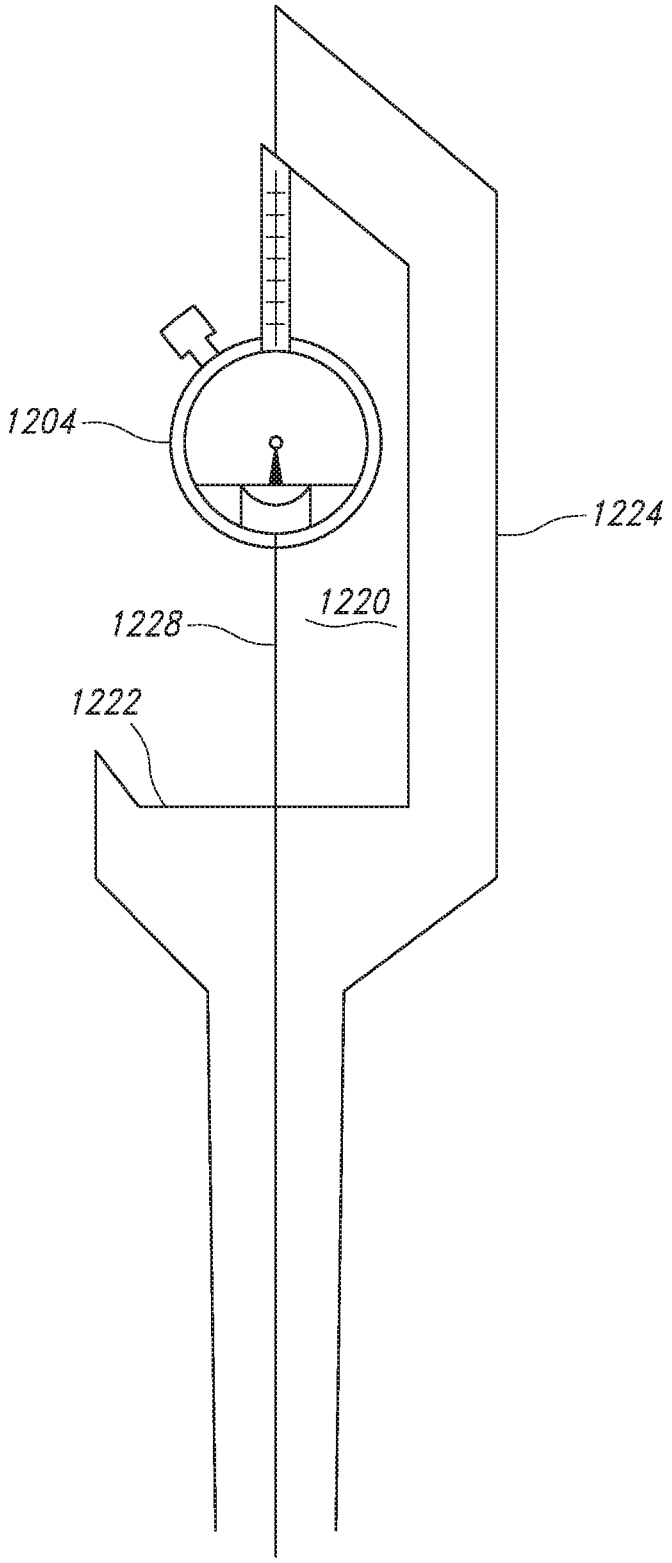
FIG. 26 is a rear elevational view of a riser with an archery accessory mounted thereon.

Turning to FIG. 26, the sight 1200 is illustrated mounted on the bow riser as disclosed herein. When the sight arm 1202 is connected to the bow riser in the centerline plane 1228, the sight element 1204 may be adjusted with the horizontal adjustment system 1210, and/or both vertical adjustment systems 1208, 1212, such that the sight element 1204 is visible to the user through the sight window 1220 of the bow riser. Specifically, the user may adjust the height of the sight element 1204 with respect to the lower wall 1222 of the sight window using one or both of the vertical adjustment systems 1208, 1212. Furthermore, the user may adjust the horizontal positioning of the sight element 1204 with respect to the vertical side wall 1224 via the horizontal adjustment system 1210. Accordingly, the user may have full capacity to select an appropriate sight element 1204 position for any given target by way of a sight 1200 connected to the bow riser within the centerline plane 1228 of the bow riser.

While the invention has been described with reference to specific examples, it will be understood that numerous variations, modifications and additional embodiments are possible, and all such variations, modifications, and embodiments are to be regarded as being within the spirit and scope of the invention. Also, the drawings, while illustrating the inventive concepts, are not to scale, and should not be limited to any particular sizes or dimensions. Accordingly, it is intended that the present disclosure not be limited to the described embodiments, but that it has the full scope defined by the language of the following claims, and equivalents thereof.

The invention claimed is:

1. An archery accessory for use with a bow riser including a vertical centerline plane, said archery accessory comprising:

an elongated sight arm adapted for connecting to the bow riser at a proximal portion of the sight arm and extending therefrom in a first horizontal direction along a longitudinal axis of the sight arm;

a micro-adjust windage system at a distal portion of the sight arm, said micro-adjust windage system adapted to move horizontally between a first position and a second position in a second horizontal direction perpendicular to the first horizontal direction;

an elevational adjustment system comprising a sight mounting block adapted to move in a vertical direction; and a sight element extending in the vertical direction away from the sight mounting block for use in aiming at a target;

wherein the micro-adjust windage system and the elevational adjustment system are adapted to move the sight element horizontally and vertically, respectively; and wherein the sight arm is adapted to connect to the bow riser such that the vertical centerline plane is between the first position and the second position.

2. The archery accessory of claim 1, wherein movement of both the micro-adjust windage system and the sight element is limited to between the first position and the second position in the second horizontal direction.

3. The archery accessory of claim 1, wherein the micro-adjust windage system is distal to the elevational adjustment system.

4. The archery accessory of claim 1, wherein the micro-adjust windage system is proximal to the elevational adjustment system.

5. The archery accessory of claim 1, further including a second vertical adjustment system, wherein the second vertical adjustment system is adapted to move the sight element vertically.

6. The archery accessory of claim 5, wherein the second vertical adjustment system is adapted to impart more fine adjustment of the sight element than the elevational adjustment system.

7. The archery accessory of claim 5, wherein the second vertical adjustment system comprises a threaded aperture adapted to receive a threaded rod.

8. The archery accessory of claim 1, wherein the micro-adjust windage system comprises a slide, a bolt and carriage, a knob, or a lever.

9. The archery accessory of claim 1, wherein the elevational adjustment system comprises a slide, a bolt and carriage, a knob, or a lever.

10. An archery sight for use with a bow riser, said archery sight comprising:

an elongated sight arm adapted for connecting to the bow riser at a proximal portion of the sight arm and extending therefrom in a first horizontal direction along a longitudinal axis of the sight arm;

a sight element for use in aiming at a target attached to a distal portion of the sight arm;

a horizontal adjustment system adapted for moving the sight element horizontally in a second horizontal direction perpendicular to the first horizontal direction, wherein a complete range of motion of the horizontal adjustment system in the second horizontal direction is limited to between a first position and a second position in the second horizontal direction;

a first vertical adjustment system adapted for moving the sight element vertically; and a second vertical adjustment system adapted for moving the sight element vertically;

wherein the second vertical adjustment system is positioned below the first vertical adjustment system and wherein an entirety of the sight element is limited to movement between the first position and the second position in the second horizontal direction.

11. The archery sight of claim 10, wherein the sight arm is adapted to connect to the bow riser such that a vertical centerline plane of the bow riser is between the first position and the second position.

12. The archery sight of claim 10, wherein the first vertical adjustment is adapted to impart a greater range of movement of the sight element than the second vertical adjustment.

13. The archery sight of claim 10, wherein the horizontal adjustment system is proximal on the sight arm to the first vertical adjustment system and the second vertical adjustment system, and wherein the horizontal adjustment system is adapted to move the first vertical adjustment system and the second vertical adjustment system in the second horizontal direction.

14. The archery sight of claim 10, wherein the first vertical adjustment system comprises a slide, a bolt and carriage, a knob, or a lever, and the second vertical adjustment system comprises a threaded aperture adapted for receiving a threaded rod.

15. The archery sight of claim 14, wherein the first vertical adjustment system comprises a bolt and carriage, and the threaded rod of the second vertical adjustment system includes a longitudinal axis parallel with a longitudinal axis of the bolt of the first vertical adjustment system.

16. The archery sight of claim 15, wherein the longitudinal axis of the threaded rod is continuous with the longitudinal axis of the bolt.

* * * * *